US006753489B2

(12) United States Patent
Kiyono et al.

(10) Patent No.: US 6,753,489 B2
(45) Date of Patent: Jun. 22, 2004

(54) SWITCH, PUSH-BUTTON SWITCH AND ROTARY-LEVER SWITCH

(75) Inventors: Yasuhiro Kiyono, Kyoto (JP); Toshihiro Naruo, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/222,981

(22) Filed: Aug. 19, 2002

(65) Prior Publication Data

US 2003/0079980 A1 May 1, 2003

(30) Foreign Application Priority Data

Aug. 20, 2001 (JP) ..... 2001-249003
Dec. 3, 2001 (JP) ..... 2001-368333

(51) Int. Cl.[7] ..... H01H 29/16
(52) U.S. Cl. ..... 200/200; 200/559
(58) Field of Search ..... 200/200, 506, 200/510, 532, 293.1, 329, 341, 559

(56) References Cited

U.S. PATENT DOCUMENTS 3,883,705 A * 5/1975 Sebastian et al. ..... 200/6 B
3,946,181 A * 3/1976 Takamizawa et al. ..... 200/531
4,182,939 A * 1/1980 Feaster ..... 200/17 R
4,191,867 A * 3/1980 Feaster ..... 200/16 R
5,667,062 A * 9/1997 Yasufuku et al. ..... 200/536
6,326,570 B1 * 12/2001 Fujii et al. ..... 200/520
6,525,285 B2 * 2/2003 Kudo et al. ..... 200/559
6,559,401 B2 * 5/2003 Minami et al. ..... 200/559
6,633,013 B2 * 10/2003 Nishimura et al. ..... 200/559

FOREIGN PATENT DOCUMENTS

JP 2-12718 * 6/1988
JP 2-186519 * 1/1989

* cited by examiner

*Primary Examiner*—Michael Friedhofer
*Assistant Examiner*—Lisa Klaus
(74) *Attorney, Agent, or Firm*—Morrison & Foerster LLP

(57) ABSTRACT

The present invention is provided with a contact switching mechanism having a movable contact member that is bent into a U shape, allowed to press and contact a fixed contact member side, and supported so as to freely tilt and move thereon. In this mechanism, a switching operation is carried out between contacts by reversing the movable contact member in a see-saw manner, with a tilt-movement fulcrum portion of the movable contact member being always in contact with the contact portion of the common fixed contact member. The movable contact member is allowed to have a spring function conformed to elastically shift in response to a switching operation in addition to a contact function that is inherent to the movable contact member so that it is possible to provide a switch having high reliability, such as a push-button switch and a rotary-lever switch, which can cut costs by reducing the number of parts, and ensure a superior contacting property.

17 Claims, 42 Drawing Sheets

11 ··· Push button switch
14 ··· Push button

14 ··· Push button
14c ··· Tilt protrusion 16 to 18 ··· Fixed terminal
16a ··· Fixed fulcrum portion
19 ··· Movable member
19a ··· Tilt-movement fulcrum portion 11 ··· Push-button switch
14 ··· Push button
14c ··· Tilt protrusion
16a ··· Fixed fulcrum portion
19 ··· Movable member
19a ··· Tilt movement fulcrum portion 11 ··· Push-button switch
14 ··· Push button
16 to 18 ··· Fixed terminal
19 ··· Movable member 11 ··· Push-button switch
14 ··· Push button
14c ··· Tilt protrusion
16a ··· Fixed fulcrum portion
19 ··· Movable member
19a ··· Tilt-movement fulcrum portion 11 ··· Push-button switch
14 ··· Push button
14c ··· Tilt protrusion
16a ··· Fixed fulcrum portion
19 ··· Movable member
19a ··· Tilt-movement fulcrum portion 11 ··· Push-button switch
14 ··· Push button
14c ··· Tilt protrusion
16a ··· Fixed fulcrum portion
19 ··· Movable member
19a ··· Tilt-movement fulcrum portion 11 ··· Push-button switch
14 ··· Push button
19 ··· Movable member
16 to 18 ··· Fixed terminal 11 ··· Push-button switch
14c ··· Tilt protrusion
16a ··· Fixed fulcrum portion
19 ··· Movable member
19a ··· Tilt-movement fulcrum portion 141 ··· Rotary switch lever
144 ··· Rotary lever 144 ··· Rotary lever
144c ··· Semi-circular sliding protrusion 141 ··· Rotary switch (-lever)
144 ··· Rotary lever
144c ··· Semi-circular sliding protrusion
146a ··· Fixed fulcrum portion
149 ··· Movable member
149a ··· Tilt-movement fulcrum portion 141 ··· Rotary switch (lever)
144 ··· Rotary lever
146 to 148 Fixed terminal
149 ··· Movable member 141 ··· Rotary switch (lever)
144 ··· Rotary lever
144c ··· Semi-circular sliding protrusion
146a ··· Fixed fulcrum portion
149 ··· Movable member
149a ··· Tilt-movement fulcrum portion 141 ··· Rotary switch (lever)
144 ··· Rotary lever
144c ··· Semi-circular sliding protrusion
146a ··· Fixed fulcrum portion
149 ··· Movable member
149a ··· Tilt-movement fulcrum portion 141 ··· Rotary switch (lever)
144 ··· Rotary lever
146a ··· Fixed fulcrum portion
149 ··· Movable member
149a ··· Tilt-movement fulcrum portion 141 ··· Rotary switch -lever
144 ··· Rotary lever
146 to 148 ··· Fixed terminal
149 ··· Movable member lever 141 ··· Rotary switch
144 ··· Rotary lever
144c ··· Semi-circular sliding protrusion
146a ··· Fixed fulcrum portion
149 ··· Movable member
149a ··· Tilt-movement fulcrum portion 11 ··· Push-button switch
14c ··· Tilt protrusion
16 ··· Fixed terminal
16a ··· Fixed fulcrum portion
19 ··· Movable member
19a ··· Tilt-movement fulcrum portion 11 ··· Push-button switch
14c ··· Tilt protrusion
19 ··· Movable member
19a ··· Tilt-movement fulcrum portion 11 ··· Push-button switch
14c ··· Tilt protrusion
16a ··· Fixed fulcrum portion
19 ··· Movable member
19a ··· Tilt-movement fulcrum portion
19e ··· Elbowed shaped bent portion 271 ··· Push-button switch
274 ··· Push button 271 ··· Push-button switch
274 ··· Push button
276 to 278 ··· Fixed terminal
279 ··· Movable member 274 ··· Push button
274c ··· Tilt protrusion 271 ··· Push-button switch
274 ··· Push button 272i ··· Excessive tilt-movement regulating protrusion 271 ··· Push-button switch
274 ··· Push button
276 to 278 ··· Fixed terminal
279 ··· Movable member 271 ··· Push-button switch
274 ··· Push button
274c ··· Tilt protrusion
276a ··· Fixed fulcrum portion
279 ··· Movable member
279a ··· Tilt-movement fulcrum portion 274c ··· Tilt protrusion
279 ··· Movable member 271A··· Push-button switch
272i ··· Excessive tilt-movement regulating protrusion
274 ··· Push button 274c··· Tilt protrusion
279 ··· Movable member 271B··· Push-button switch
272i ··· Excessive tilt-movement regulating protrusion
274 ··· Push button 274c ··· Tilt protrusion
279 ··· Movable member 271 ··· Push-button switch
274 ··· Push button 276, 277 ··· Fixed terminal 279 ··· Movable member 421i ··· Excessive tilt-movement regulating protrusion

SWITCH, PUSH-BUTTON SWITCH AND ROTARY-LEVER SWITCH

TECHNICAL FIELD OF THE INVENTION

The present invention relates to a switch for use in, for example, a door switch in a refrigerator, and in particular, to a switch such as a push-button switch and a rotary-lever switch which can reduce the number of parts and also achieve stable contact performances.

BACKGROUND OF THE INVENTION

In general, a switch used for a domestic electric appliance, for example, a door switch installed in a domestic refrigerator, has switching functions which turns on and off a lamp in the refrigerator, and also turns on and off a cooling motor, when the door of the refrigerator is opened and closed.

The amount of protrusion of an operation unit (actuator) for the switch to be press-down operated tends to vary due to a dimensional error between the external shape of the door switch and the shape of a recessed portion of the attaching position in the refrigerator. This results in the operation unit tending to have an excessive or insufficient operation in its stroke, making it difficult to maintain switching functions of the door switch.

In order to obtain stable on-off operations without having adverse effects caused by deviations in attaching precision in the door switch, a longer operation stroke is required in the operation direction. However, at present, the application of a longer operation stroke makes the switch itself become bulky, and might cause damages to switching parts due to an over-stroke.

Depending on differences in the open-close system of the door, such as a one-side opening system and a two-side opening system, there are two types of door switches in the operation direction of the door switch. Specifically, there is a push-button type in which the switching operation is carried out by advancing or retreating in the straight line direction, and a rotary-lever type in which the switching operation is carried out while rotating. Different contact structures need to be prepared depending on the respective types.

When, upon a switching operation, the contact switching between contacts is slow, an arc tends to be caused, resulting in a defective contact. In order to prevent this defective contact, a snap action opening and closing mechanism, which quickly carries out switching between contacts, or an opening and closing mechanism having the same function, needs to be prepared.

In order to solve such a problem, a switch has been proposed in which, in cooperation with a depressing operation of a push button, a movable contact which moves in a tilted manner between a tilt position having a tilt angle of approximately 45° with one end supported by a coil spring and a vertical position so as to switch contacts (for example, see Japanese Laid-Open Patent Application No. 11-111105).

However, such a switch needs a fixed contact and a movable contact inside thereof and an exclusively-used coil spring that allows the movable contact to return to its original position. This results in a complicated contact structure, and upon assembling the switch, handling and assembling of the coil spring having an elastic force are difficult. A number of parts and manufacturing processes are also required, resulting in a limitation to cost reduction.

Although, upon switching contacts, this structure has a sliding contact function which switches contacts with the contact portion of the movable contact sliding on the contact portion of the fixed contact while removing an oxide film, it is susceptible to great abrasion and the resulting in short service life.

In addition to these problems, when one door switch is used for turning on-off the lamp illuminating the inside of a refrigerator as well as for turning on-off the cooling motor, a single-pole double-throw switch, which has a normally-closed and normally-open contact construction that turns the switch on and off in response to opening and closing of the door, is required. However, in the case of a door switch which only turns on-off the lamp or only turns on-off the cooling motor, it is easily manufactured by using only the single-pole single-throw switch that has a normally-closed or normally-open contact construction.

However, in the case of this single-pole single-throw switch, since the switch structure is different depending on the normally-closed and normally-open contact constructions, the same housing is not used commonly, and housings corresponding to different contact structures of two types need to be prepared. For this reason, at present, a single-pole single-throw door switch, which can be switched between the normally-closed state and normally-open state by using a single-switch construction, is used as a single-pole single-throw door switch, and either of the contact constructions is selectively used depending on the use.

However, when only one of the normally-closed and normally open contact constructions is selectively used, the other contact construction on the unused side is never used, making the door switch uneconomical with the unused contact parts still assembled therein, as well as causing high costs.

For this reason, it has been proposed that the contact parts on the unused side have been preliminarily omitted. However, in this case, a space is formed in the housing after the contact parts on the unused side have been removed, with the result that the movable contact member facing the space becomes difficult to take a normal amount of shift due to an excessive tilt, etc. Consequently, the movable contact member has a positional deviation or the like, making the contact structure unbalanced, thereby resulting in susceptibility to failure and degradation in the contact performance. Therefore, this case needs the addition of a revising member such as a dummy contact to prevent the movable contact member from having the excessive tilt, and since the addition of one part causes a great increase in the manufacturing costs in mass-produced switches, there has been a strong demand for the development of switches from which the dummy contact has been eliminated.

SUMMARY OF THE INVENTION

In one embodiment of the invention, the movable contact member has two functions, including a spring function configured to elastically shift in addition to a contact function, which is provided as a single commonly-used part. The invention provides a switch having high reliability, such as a push-button switch and a rotary-lever switch, which can cut costs by reducing the number of parts, achieve a small-size device and a high assembling property, and ensure a superior contacting property by using a snap action to provide a longer service life.

In another embodiment of the present invention, a switch, which has a concave-shaped housing with one side being opened, a cover for sealing the opened face and a fixed conductive contact member and a movable contact member that are placed face to face with each other in the housing such that an operative force of operation members that are held in the housing and operated is transmitted to the movable contact member so that the movable contact member is moved and shifted to connect and separate the contacts so as to carry out a switching operation, is provided with a common fixed contact member and a fixed contact member that is different from the common fixed contact member that are placed in parallel with each other in the housing. The movable contact member, which has a tilt-movement fulcrum portion that is placed orthogonal to the parallel arranging direction of the respective fixed contact members, in a manner so as to freely tilt in the orthogonal direction, while being pressed toward the common fixed contact member side, at an intermediate position on one side member of a conductive plate spring member that is bent into a U shape, and a contact portion formed at one end of the one side member in the length direction with the tilt-movement fulcrum portion in the movable shifting direction of this one side member serving as a base point, is placed. In the arrangement a contact switching mechanism is installed which carries out a switching operation by reversing the movable contact member in a seesaw manner, based upon the operative force of the operation members that are made in contact with the movable contact member along the outer face length direction on the other side member thereof, with respect to contacting and separating processes between the contact portion of the fixed contact member and the contact portion of the movable contact member that are placed face to face with each other, with the tilt-movement fulcrum portion of the movable contact member being always in contact with the contact portion of the common fixed contact member.

The switch is applicable to a door switch of a refrigerator that turns on and off in response to the door opening and closing operations.

The housing is formed, for example, so as to have a concave-shaped void portion in which constituent members of the switch are assembled, and made of a synthetic resin material that is suitable for molding process and insulation. Moreover, when the switch constituent parts are attached to the housing, the attaching process is easily carried out through the opening section, that is, the opening on one surface of the concave shape. After the assembling process, the opening face of the housing is covered with a cover having a flat-plate shape, and easily closed into a sealed state.

The above-mentioned fixed contact member is easily formed by carrying out a punching process on a conductive plate. For example, the punching process is carried out so as to form an elongated small member that has a contact portion on one side with a wire connecting portion on the other side.

The above-mentioned movable contact member may be formed by bending a conductive plate spring member into a U shape. With respect to this member, for example, one end of the U-letter shape is placed on the contact portion side with the other end being placed on the operation force receiving face side. Moreover, another member having a partially different material may be used to form the contact portion and the spring portion, in an attempt to increase opening and closing currents or to provide a longer service life. For example, a material having high conductivity is used for the contact portion and a spring material having high elasticity is used for the spring portion, and the two parts may be joined into a U shape through a caulking process.

The above-mentioned operation member may be constituted by push-buttons and levers. Normally, the outer edge portion of the operation member is pressed by a restoring spring and allowed to stick outward from the housing, and held so as to be pressed without being pulled out, and when pressed down, it is guided so as to be inserted into the housing so that switching is made between contact portions. The operation member is also formed by a synthetic resin material suitable for molding process and insulation.

The above-mentioned contact portion may be integrally formed on the movable contact member and fixed contact member, or may be formed by attaching a conductive contact member.

The above-mentioned tilt-movement fulcrum portion is constituted by integrally forming a concave portion or a convex portion at an intermediate position on one member side of the movable contact member.

The above-mentioned contact switching mechanism may be formed by attaching a movable contact member to a plurality of fixed contact member placed in parallel with each other, in a see-saw fashion so as to freely tilt and move in a manner so as to face them in a direction orthogonal thereto. Thus, the movable contact member is reversed in a see-saw fashion by receiving the operational force of the operation member so that the contact portions between the movable contact member and the fixed contact member are switched.

In accordance with another embodiment of the present invention, since the contact switching mechanism has a seesaw structure for reversing the movable contact member in response to a switching operation, the movable contact member itself serves as a dual purpose part having the inherent contact function of the movable contact member and a restoring spring function so that it is possible to cut the number of parts and the number of assembling processes. Thus, the resulting simplified inner structure makes it possible to cut costs and save space, and consequently to miniaturize the device.

Upon assembling the device into the housing, a plurality of fixed contact members are placed in the housing in parallel with each other so that no wasteful layout space is required inside the housing and they are attached efficiently in a well-aligned manner. For example, in the case when three fixed contact members are assembled therein, these are aligned in three rows, and assembled compactly.

The movable contact member, in one embodiment, is formed into a U shape so as to have a small folded shape so that it is suitable for miniaturizing the device, and the two members, placed with the bent portion of the U shape serving as an apex, are allowed to elastically shift to provide sufficient elasticity so that it is possible to provide an appropriate spring function although it has a small size. Moreover, the movable contact member is placed face to face with the respective fixed contact members so as to contact therewith in a direction orthogonal to the aligned direction of the fixed contact members. Therefore, it is possible to provide an efficient layout arrangement in the same manner as an integral layout structure of the contact portion.

Furthermore, since the operation member is placed in contact with the outer face on the other member side of the U shape of the movable contact member in the length direction thereof, the operation member is allowed to contact the other member with a long length in the length direction thereof. Therefore, it becomes possible to obtain a sufficiently long operation length (operation stroke) of the operation member. In this manner, since it is possible to obtain the long operation stroke at the time of a switching operation, the device becomes less susceptible to adverse effects due to deviations in the attaching precision of the switch, when the switching area of the contacts is set within the range of the operation stroke. For this reason, it is possible to ensure on-off operations by eliminating the insufficient stroke, and it is also possible to prevent the switching parts from being damaged by accepting excessive strokes.

Moreover, upon switching the contacts, since the movable contact member itself is formed by a plate spring member that is bent in a U shape, and the plate spring member that has been bent is reversed energetically in a see-saw fashion in such a manner that the snapping action makes it possible to switch the contacts. Thus, it becomes possible to provide a quick switching operation, and consequently to prevent the generation of an arc between the contact portions. This arrangement makes it possible to provide a superior contact performance without the generation of an arc, and also to provide a stable switching operation with high reliability.

The supporting structure, which allows the above-mentioned movable contact member to reverse in a see-saw fashion, is arranged so that a concave portion is formed in one of a tilt-movement fulcrum on the movable contact member side and a fixed fulcrum on the common fixed terminal side for receiving this, with a convex portion being formed on the other fulcrum; thus, it is possible to obtain a stable tilt-moving function by using a simple structure.

Moreover, this contact switching mechanism has a simple structure in which the movable contact member is reversed in cooperation with a switching operation so that it is readily applicable to both of the push-button switch and the rotary-lever switch, and used as a highly versatile contact-switching mechanism.

In this aspect, one fixed contact member may be placed at a position opposing to one end of the movable contact member that is tilted to move in a see-saw fashion so as to carry out the switching operation, or a first fixed contact member and a second fixed contact member may be placed at positions opposing to two ends thereof so as to carry out the switching operation. In this case, since the two fixed contact members may have the same shape, the same parts may be commonly used.

Moreover, when an excessive tilt-movement regulating protrusion which prevents the movable contact member from making excessive tilt-movements is attached to the inner wall face of the housing on the fixed contact member side, the movable contact member that is tilted to move in a see-saw fashion is regulated so as not to be excessively tilted to move because of the excessive tilt-movement regulating function of the excessive tilt-movement regulating protrusion. Therefore, even when the contact parts on the unused side have been preliminarily omitted to form a space in the corresponding portion, the excessive tilt-movement regulating protrusion regulates the excessive tilt-movements of the movable contact member at the position of the space, thereby making it possible to maintain an appropriate tilt-movement state.

This excessive tilt-movement regulating protrusion is integrally formed on the inner wall face of the housing on the fixed contact member side so as to protrude toward the movable contact member side, and the amount of protrusion is designed so as to accept and receive the end of the movable contact member at a position retreated from the contact face position of the contact portion of the fixed contact member. Thus, it is maintained so as not to enter the reversing operation area of the movable contact member, and it becomes possible to ensure a stable reversing operation.

With this arrangement, the same housing can be commonly-used in all the switches of the single-pole double-throw switch and the single-pole single-throw switch having different contact structures. Moreover, the above-mentioned structure regulates the excessive tilt-movements of the movable contact member to prevent unstable movements such as positional deviations in the movable contact member; therefore, it is possible to appropriately maintain the balance of the contact structure, and consequently to maintain a stable switching operation. Thus, this arrangement makes it possible to omit a revising member such as a dummy contact, to obtain a stable contact performance by reducing the number of parts, and also to cut costs by commonly utilizing the housing.

When such a contact-switching mechanism is applied to, for example, a push-button switch, it is attached in such a manner that an external operation force is applied in the same direction as the advancing and retreating directions of the push button. Thus, in response to the advancing and retreating movements of the push button at this time, the U shaped movable contact member is elastically shifted so that the contacts between the movable contact member and the fixed contact member are elastically made in contact with and separated from each other so as to carry out a switching operation.

In the same manner, when such a contact-switching mechanism is applied to, for example, a rotary-lever switch, it is attached with such a pressure applying direction that with respect to the lever rotation direction, an external operation force is smoothly applied toward the rotation direction of the lever. For example, this is attached to the door of a refrigerator of double-sides opening type, the operation forces, applied when the door is opened and closed, are exerted virtually in parallel with the surface of the housing so that the lever, which protrudes from the surface of the housing, receives the operation force exerted in the surface direction, and is operated and switched with its one end being inserted into the housing while rotating on the rotation fulcrum.

In this case, the movable contact member having a U shape is elastically shifted in accordance with the rotation movement of the lever so that the switching operation is carried out with the contact portions between the movable contact member and the fixed contact members being elastically made in contact with and separated from each other.

Here, with respect to the movable contact member having a U shape, the opened end portion on the other member side is preferably bent inward into an elbowed shape so as to form an elbowed-shaped bent portion. This elbowed-shaped bent portion is designed so that, even when the operation force of the operation member, for example, a push-in force of the push button in the vertical direction, is exerted, the apex of the elbowed-shaped bent portion always serves as a contact point. Therefore, it is possible to provide a stable contacting force of the contacts in addition to the elastic function of the movable contact member having a U shape.

Moreover, with respect to the movable contact member having a U shape, a slide-contacting protrusion having a thin semi-circular shape, which protrudes in the length direction, is formed in the outer-surface center portion on the other member side, and the operation member is allowed to contact this slide-contacting protrusion in the length direction at the time of the operation. The formation of this slide-contacting protrusion provides not a face contact, but a point contact, at the time of slide-contacting the operation member when the switching operation is carried out. Therefore, the two members become less susceptible to mutual abrasions, thereby making it possible to provide a longer service life and smoother movements.

DETAILED DESCRIPTION OF THE INVENTION

Referring to the figures, the following description will discuss embodiments of the present invention.

First Exemplary Embodiment

Figure 1:
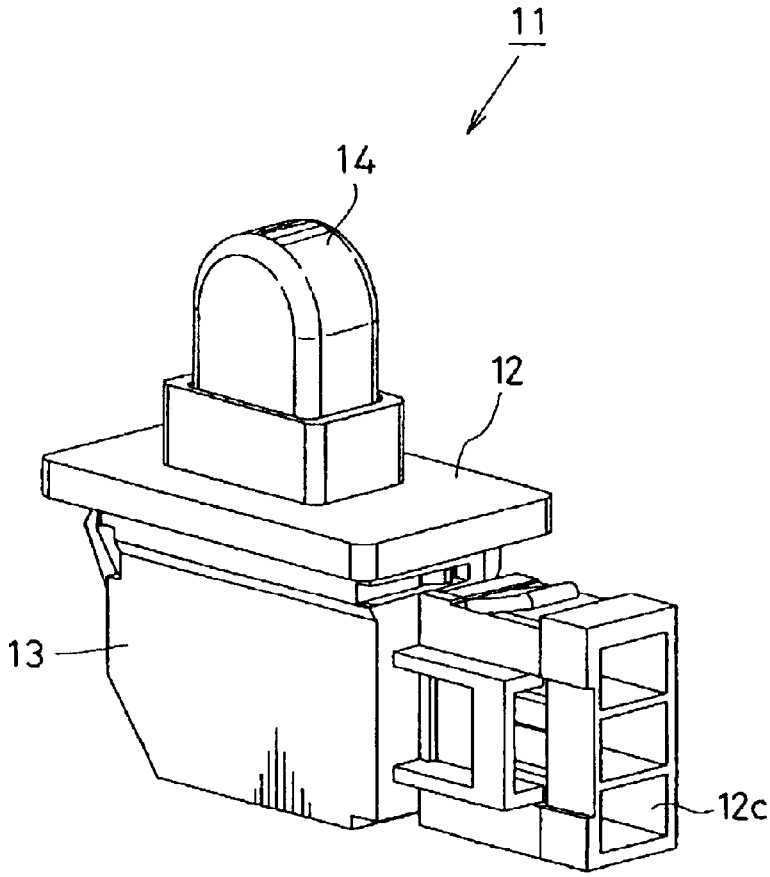
FIG. 1 is a perspective view showing an external appearance of a push-button switch.
Figure 2:
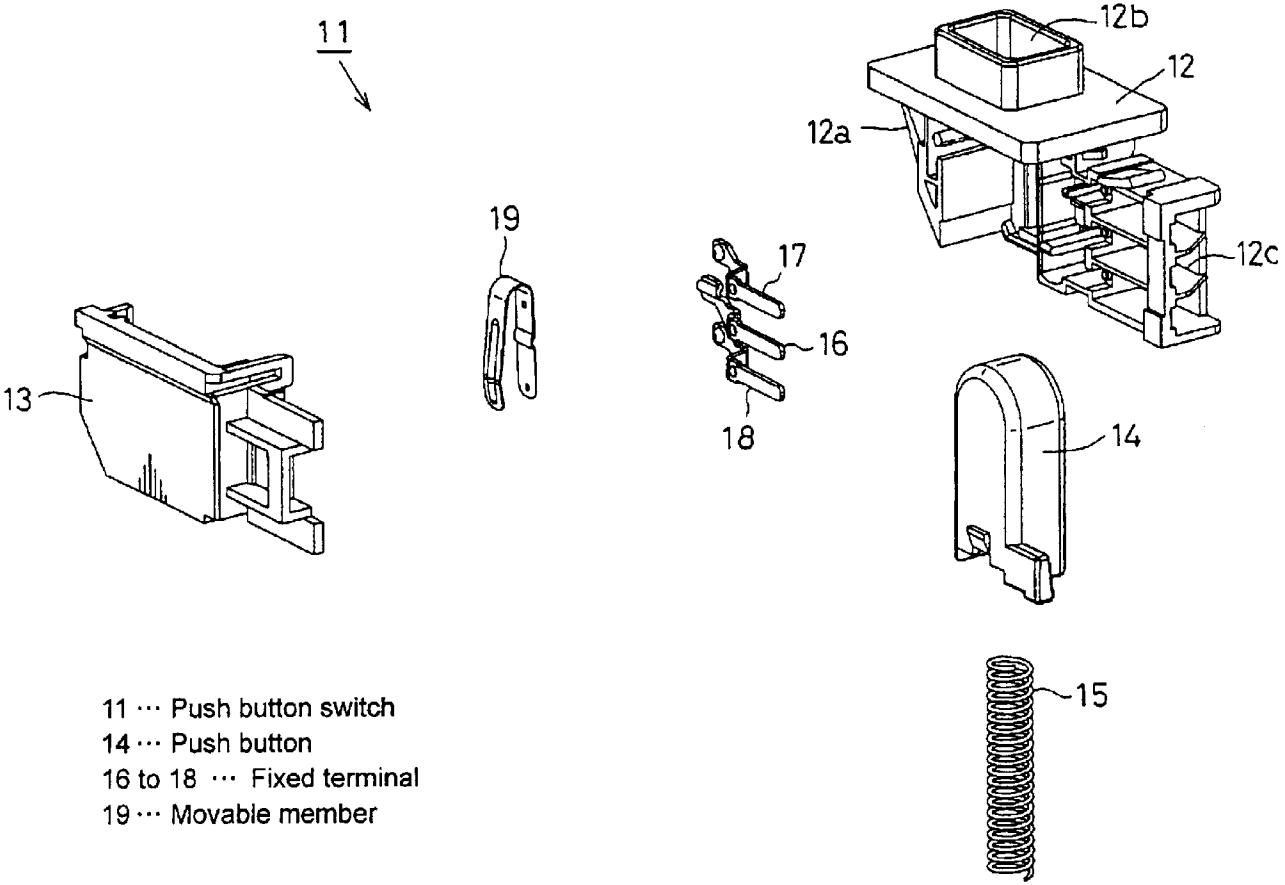
FIG. 2 is a perspective development showing the push-button switch.

The figures show push-button switches to be used in a door switch of a refrigerator. In FIGS. 1 and 2, the push-button switch 11 comprises a housing 12, a cover 13, a push-button 14, a restoring spring 15, three fixed terminals 16 to 18 and a movable member 19 that are integrally assembled.

The housing 12 has a hollow section inside thereof in which the above-mentioned constituent parts are assembled, and this hollow section is sealed with a cover 13, which will be described later.

Figure 3:
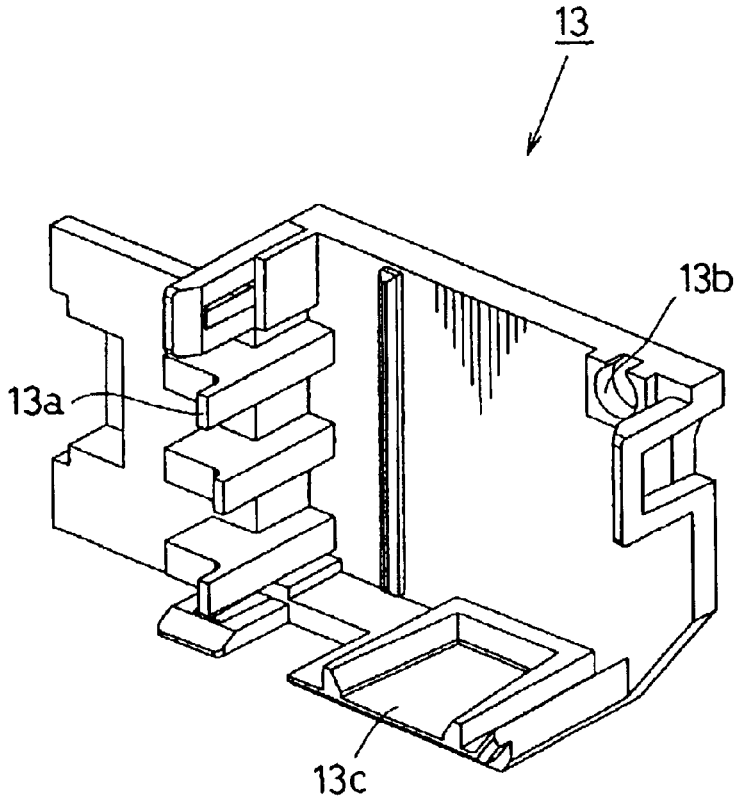
FIG. 3 is an enlarged perspective view that shows a cover of the push-button switch.

FIG. 3 shows the cover 13, and the cover 13 is inserted through a side face opening 12*a* (see FIG. 2) of the housing 12, and attached thereto, and partition members 13*a*, which individually divide fixed terminals 16 to 18 and a movable member 19, which will be described later, and support these, are installed on the inner face of the cover.

Moreover, a shaft support unit 13*b*, which is designed so as to be commonly used for a rotary-lever switch having a different type in specifications, is placed on one side of the upper portion of the cover 13 so that this cover 13 of one type is commonly used for both of the switch of the push-button type and the switch of the rotary lever type.

Figure 4:
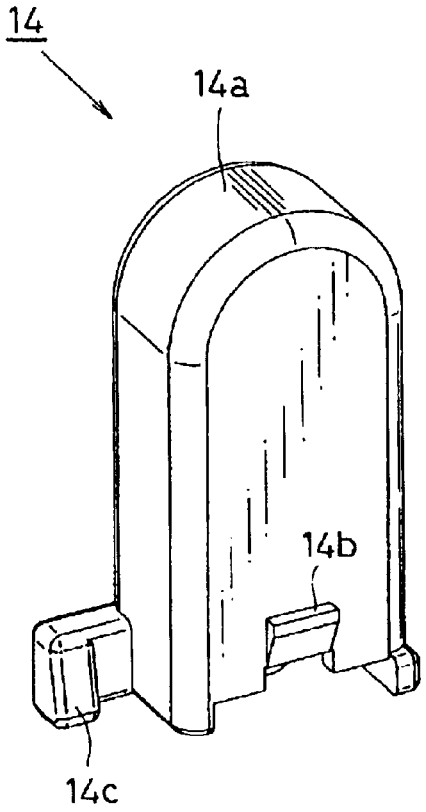
FIG. 4 is an enlarged perspective view showing the push-button.

FIG. 4 shows a push button 14, and this push button 14 has an upper portion side that is extended long in the vertical direction as a pressing face 14*a*, and a pair of come-off stopping protrusions 14*b* are formed on both of the side faces of the lower portion so as to stick out therefrom. This push button 14 is inserted into a cylinder section 12*b* of the housing 12 from below so as to slide in the vertical direction with the cylinder section 12*b* serving as a guide, so that the pressing face 14*a* of the push button 14 sticks upward in a pressable state with a pressing force of a restoring spring 15, which will be described later, being applied thereto. In this case, the come-off stopping protrusions 14*b* are engaged by engaging units inside the housing, not shown, so that the push button 14 is supported in the housing 12 so as not to come off.

Moreover, a tilt protrusion 14*c* is placed on one side of the lower portion of this push button 14 so that this tilt protrusion 14*c* is allowed to contact a movable member 19, which will be described later, so as to carry out a switching operation.

The above-mentioned restoring spring 15 is made of a coil spring with its upper end being inserted into a lower-face concave section 14*d* (see FIG. 7) of the push button 14, while its lower end is allowed to elastically press a spring mount 13*c* formed on the lower face of the cover 13, so that it is housed and supported in the housing 12 in a compressable state in the vertical direction so as to press the push button 14. In the drawing, reference numeral 12*c* is a terminal connecting outlet.

Figure 5:
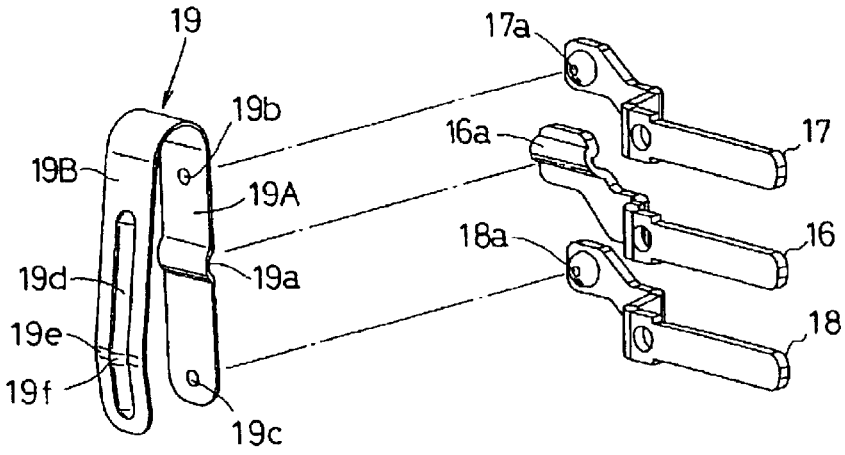
FIG. 5 is a perspective view that shows external appearances of a movable member and a fixed terminal of the push-button switch.

FIG. 5 shows three fixed terminals 16 to 18 and one movable member 19 that are contact constituent members, and the respective fixed terminals 16 to 18, each independently formed into a long, thin flat-plate shape by a conductive metal plate, are placed in three rows in parallel with each other, and a first fixing terminal 17 is placed in an upper position sandwiching the common fixed terminal 16 at the intermediate position and a second fixing terminal 18 is placed in a lower position of the housing 12 integrally in parallel with each other, with the common fixing terminal 16 having a fixed fulcrum 16*a* that is formed on the plane face of the end portion in a manner so as to protrude in a chevron. Moreover, a small first fixing contact portion 17*a* having a semi-spherical shape is attached to the plane face of the end portion of the first fixing terminal 17 that is placed on the upper position, and a small second fixing contact portion 18*a* having a semi-spherical shape is attached to the plane face of the end portion of the second fixing terminal 18 that is placed on the lower position. In this case, since the first fixing terminal 17 and the second fixing terminal 18 have the same shape and the same functions, these are commonly formed by the same part.

Moreover, in addition to respective fixed contact portions 17*a*, 18*a* of the first fixed terminal 17 and the second fixed terminal 18 that are placed as different parts, the end of each of the fixed terminals 17, 18 is formed in a manner so as to stick out as a sticking-out contact, and these may be formed by using the same parts.

The movable member 19 is formed in a long bent U shape by using a metal plate having a conductive spring property, and, of the two members 19A, 19B having this bent portion as an apex, a tilt-movement fulcrum 19*a* that serves as a concave section relating to the protruding fixed fulcrum 16*a* is formed in the tip of the common fixed terminal 16 on one member side 19A, and a first movable contact portion 19*b* that sticks out toward the fixed contact side is formed on the upper portion of the tilt-movement fulcrum 19*a*, while a second movable contact portion 19*c* that sticks out toward to the fixed terminal side is formed on the lower portion of the tilt-movement fulcrum 19*a*. In this case also, the respective movable contact portions 19*b*, 19*c* are not limited to the protruding shape, and may be formed by attaching contact-use separated parts thereto.

Here, the tilt-movement fulcrum 19*a* of the movable member 19 and the fixed fulcrum 16*a* of the common fixed terminal 16 are engaged as the concave and convex portions, and supported in a manner so as to freely tilt and move. In this case, the other member side 19B of the movable member 19 is pressed by a tilt protrusion 14*c* of the push button 14 so as to be pressed toward one member side 19A so that the contact portions with the fixed terminal side are in a contacted state. Thus, upon a switching operation, when the push button 14 and the tilt protrusion 14*c* integrally formed are vertically moved to exceed the position of the tilt fulcrum 19*a*, the pressing force exerted on the upper portion of the movable member is switched to a pressing force exerted on the lower portion of the movable member, and based upon this force, the movable member 19 is allowed to reverse in a see-saw fashion on the tilt-movement fulcrum 19*a* so that the contacts are switched. For this reason, upon a switching operation, the movable member 19 is allowed to tilt and move, and pressed so that either of the movable contact portions 19*b*, 19*c* is pressed to contact the fixed contact portion 17*a*, 18*a* of the opposing fixed terminals 17, 18, thereby allowing electrical conduction. Moreover, when the pressing operation of the push button 14 is released, the movable member 19 is allowed to carry out a reverse operation in an opposite manner with the tilt-movement fulcrum 19*a* serving as the tilt-movement fulcrum, thereby returning to the original state of the contacts.

Moreover, with respect to the U-shaped movable member 19, a sliding protrusion 19*d*, which sticks out with an elongated semi-circular shape in the length direction in the center portion of the outer face of the other member 19B, is formed thereon, and the tilt protrusion 14*c* of the push button 14 is allowed to contact the sliding protrusion 19*d* along the length direction thereof.

In this case, since the sliding protrusion 19*d* is attached to the movable member 19 so that it is allowed to make not a face contact, but a point contact with the tilt protrusion 14*c* of the push button 14 at the time of a switching operation so that the mutual members are less susceptible to abrasions, thereby making it possible to provide a longer service life as well as smooth movements.

Moreover, the lower end of the other member 19B is bent inward into an elbowed shape so as to form an elbowed-shaped bent portion 19*e*. This elbowed-shaped bent portion 19*e* is designed so that, even when a push-in force of the push button 14 is exerted, the apex 19*f* of the sliding protrusion 19*d* on the elbowed-shaped bent portion 19*e* always serves as a contact point; therefore, it is possible to provide a stable contacting force in addition to the elastic function of the movable contact member having a U shape (see explanations of FIGS. 24 to 26, which will be given later).

Figure 6:
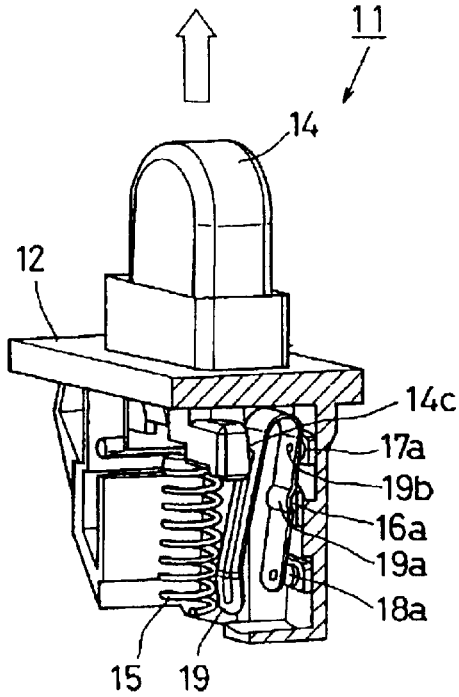
FIG. 6 is an exploded perspective view that shows an essential portion of the push-button switch in a push-down stand-by state.
Figure 7:
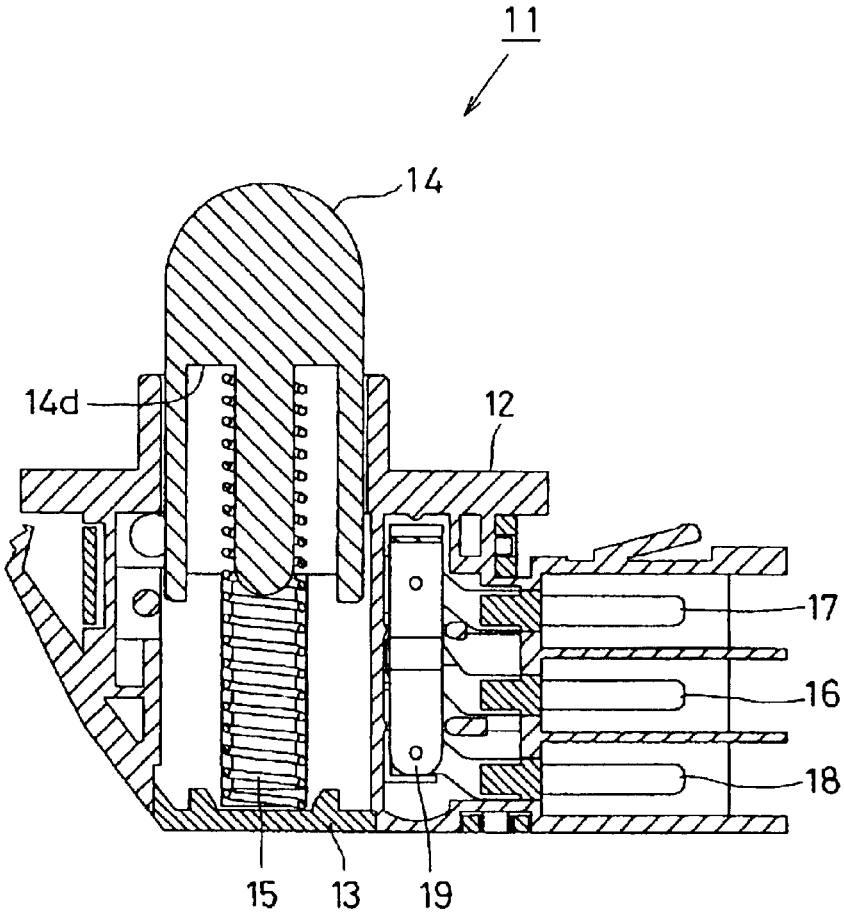
FIG. 7 is a longitudinal cross-sectional side view that shows the push-button switch in a push-down stand-by state.
Figure 8:
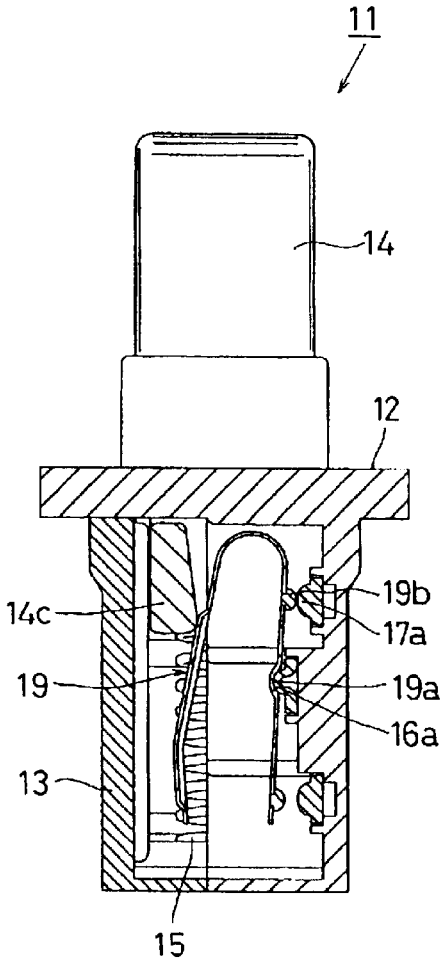
FIG. 8 is a longitudinal cross-sectional front view that shows the push-button switch in a push-down stand-by state.

In the push-button switch 11 having the above-mentioned arrangement, in a state in which the push button 14 is not pressed while the door is open, as shown in FIGS. 6 to 8, the other member 19B of the upper portion of the movable member is pressed by the tilt protrusion 14*c* of the push button so that the tilt-movement fulcrum 19*a* of the movable member 19 is supported by the fixed fulcrum 16*a* of the common fixed terminal 16, and is always maintained in a contact state, while the first movable contact portion 19*b* on the upper portion of the movable member is allowed to contact the first fixed contact portion 17*a* of the first fixed terminal 17 so that the common fixed terminal 16 and the first fixed terminal 17 are maintained in a conductive state through the movable member 19.

Figure 9:
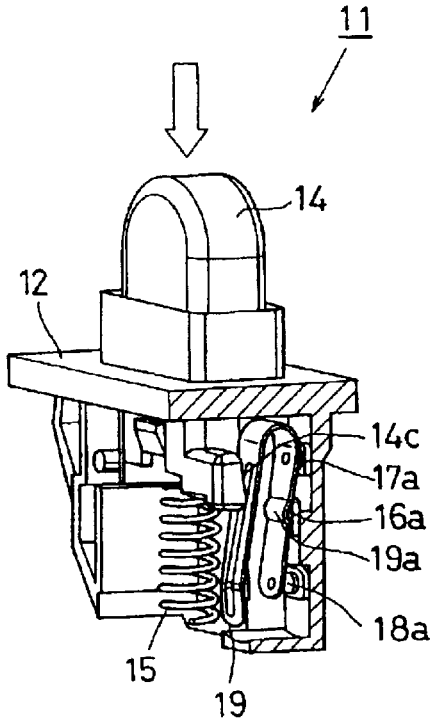
FIG. 9 is an exploded perspective view that shows an essential portion of the push-button switch in a state where the push-button switch is being pressed.

Next, when the push button 14 is operated and pressed as shown in FIG. 9, the push button 14 is shifted downward straightly against a pressing force of the restoring spring 15 so that the upper portion of the push button 14 is pushed into the housing 12.

Figure 10:
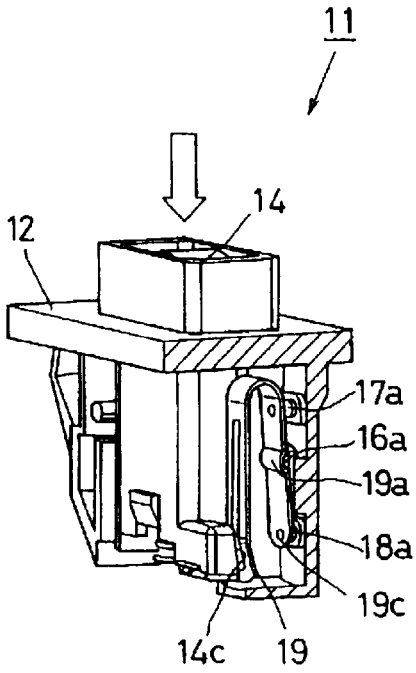
FIG. 10 is an exploded perspective view that shows an essential portion of the push-button switch in a push-down stand-by state.
Figure 11:
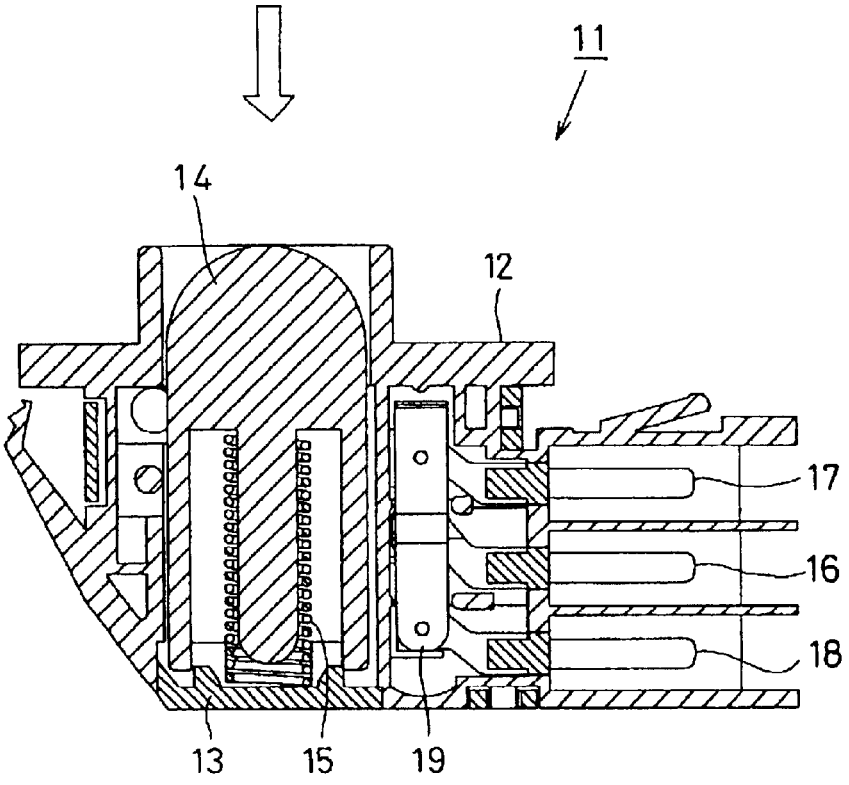
FIG. 11 is a longitudinal cross-sectional side view that shows the push-button switch in a push-down stand-by state.
Figure 12:
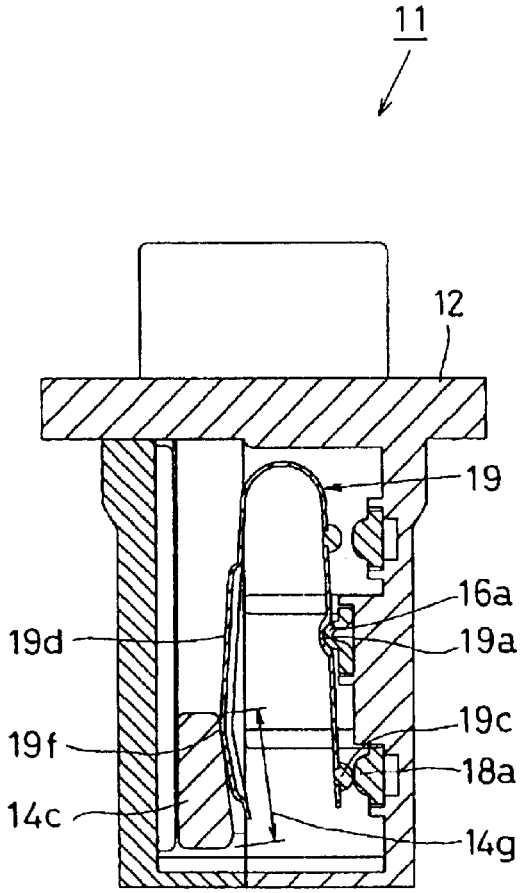
FIG. 12 is a longitudinal cross-sectional front view that shows the push-button switch in a push-down stand-by state.

At this time, the tilt protrusion 14*c* of the push button 14 is allowed to advance while sliding along the other member 19B of the movable member 19 having a spring property, and when this passes through the position of the tilt-movement fulcrum 19*a* of the movable member 19, the movable member 19 is reversed in a see-saw fashion on the tilt-movement fulcrum 19*a* because of an elastic force holding property of the U shape, as shown in FIGS. 10 to 12, with the result that the first movable contact portion 19*b*, which has been in a conductive state, is separated from the first fixed contact portion 17*a* to become nonconductive, while, instead of this, the second movable contact portion 19*c* is allowed to contact the second fixed contact portion 18*a* so that the common fixed terminal 16 and the second fixed terminal 18 are set in a conductive state.

When the movable member 19 is reversed, the movable member itself is energetically reversed instantaneously due to a snapping operation resulting from a repulsive force of the U-shaped plate spring member so that it is possible to eliminate the generation of an arc and also prevent the generation of an oxide film. Thus, it becomes possible to provide a stable contact performance with high reliability.

When the push button 14 is further pushed down, the lower end of the push button 14 comes into contact with the bottom face of the cover 13, and stopped. When the external force of the push button 14 is released from this pushed-down state, the push button 14 is allowed to retreat to the original pushed-down stand-by position by receiving a restoring force of the restoring spring 15, and the movable member 19 is also reversed to return to the original position. Thus, the contact portions carry out reverse operations in a manner opposite to the above-mentioned movements, to return to the initial state, thereby carrying out a switching operation between the contacts.

Moreover, when the tilt length 14*g* (see FIG. 12) of the tilt protrusion 14*c* of the push button 14 that is allowed to contact the sliding protrusion 19*d* of the movable member 19 is made longer, it is possible to obtain a longer push-down stroke with respect to the movable member 19, and consequently to improve the contact stability to the movable member 19.

Here, the supporting structure which allows the movable member 19 to be reversed in a see-saw fashion is preferably designed so that one of the tilt-movement fulcrum 19*a* on the movable member 19 side and the fixed fulcrum 16*a* on the common fixed terminal 16 side for receiving this is formed as a concave section with the other portion being formed as a convex portion; thus, it is possible to provide a stable tilt-moving function by using a simple structure. In the above-mentioned example, the convex portion is formed on the common fixed terminal-16 side with the concave section being formed on the movable member 19 side. However, the present invention is not intended to be limited by this arrangement.

Figure 13A:
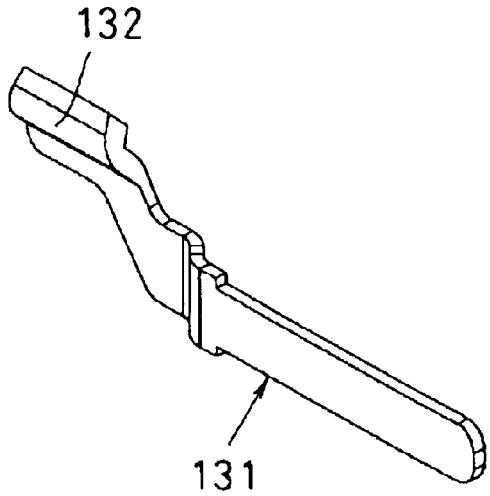
FIG. 13 is an enlarged perspective view that shows a common fixed terminal in accordance with another embodiment.
Figure 13B:
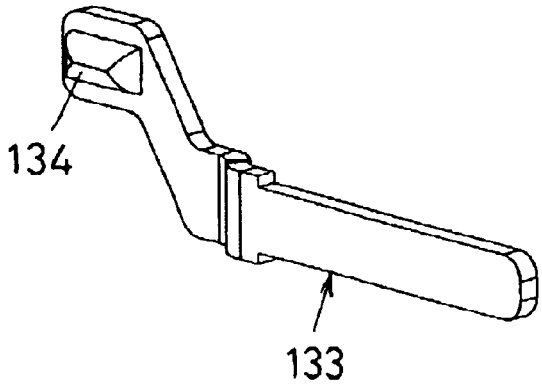

Moreover, with respect to the convex shape of the fixed fulcrum 16*a*, one portion of the metal flat plate of the common fixed terminal 16 is partially formed into a convex shape to provide this. However, in the same manner, as shown in FIG. 13A, the entire upper side of the flat plate tip portion of the common fixed terminal 131 may be formed so as to protrude to provide a fixed fulcrum 132, or as shown in FIG. 13B, one portion of the flat plate tip portion of the common fixed terminal 133 may be partially formed so as to stick out to provide a fixed fulcrum 134.

In this manner, since the push button switch 11 has a contact switching mechanism having a see-saw structure which reverses the movable member 19 in response to a switching operation, the movable member itself is allowed to serve as a dual purpose part that has a contact function as its inherent function of the movable member and also has a restoring spring function; thus, it is possible to reduce the number of parts and the number of assembling processes, and the result simplified inner structure makes it possible to cut costs and save space, and consequently to miniaturize the device.

In particular, upon assembling the device into the housing 12, a plurality of fixed terminals 16 to 18 are placed in the housing in parallel with each other so that no wasteful layout space is required inside the housing and they are attached efficiently in a well-aligned manner.

Moreover, with respect to the movable contact member 19, it is formed into a U shape so as to have a small folded shape so that it is suitable for miniaturizing the device, and the two members, placed with the bent portion of the U shape serving as an apex, are allowed to elastically shift to provide sufficient elasticity so that it is possible to provide an appropriate spring function although it has a small size. Moreover, the movable contact member 19 is placed face to face with the respective fixed terminals 16 to 18 so as to contact therewith in a direction orthogonal to the aligned direction of the fixed terminals 16 to 18. Therefore, it is possible to provide an efficient layout arrangement in the same manner as an integral layout structure of the contact portion.

Furthermore, since the tilt protrusion 14*c* of the push button 14 is placed in contact with the outer face on the other member 19B of the U shape of the movable contact member 19 in the length direction thereof, the push button 14 is allowed to contact the other member 19B with a long length in the length direction thereof. Therefore, it becomes possible to obtain a sufficiently long operation stroke of the push button. In this manner, since it is possible to obtain the long operation stroke at the time of a switching operation, the device becomes less susceptible to adverse effects due to deviations in the attaching precision of the switch, when the switching area of the contacts is set within the range of the operation stroke. For this reason, it is possible to ensure on-off operations by eliminating the insufficient stroke, and it is also possible to prevent the switching parts from being damaged by accepting an excessive stroke.

Second Exemplary Embodiment

The following description will discuss a case in which, instead of the push button switch 11, a rotary-lever switch is used as a door switch of a refrigerator, in the same manner.

Figure 14:
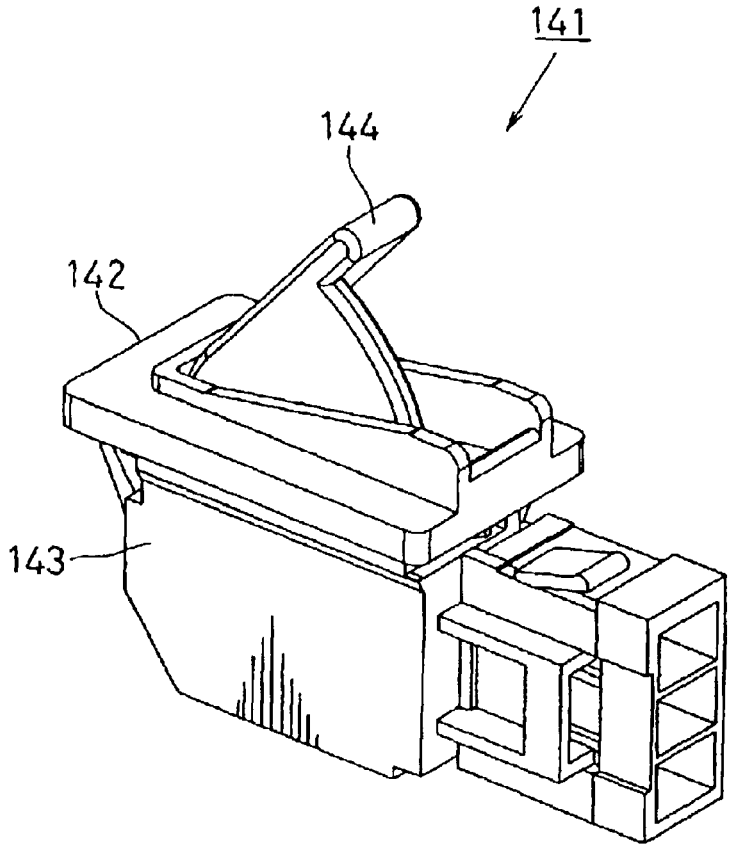
FIG. 14 is a perspective view that shows an external appearance of a rotary-lever switch.
Figure 15:
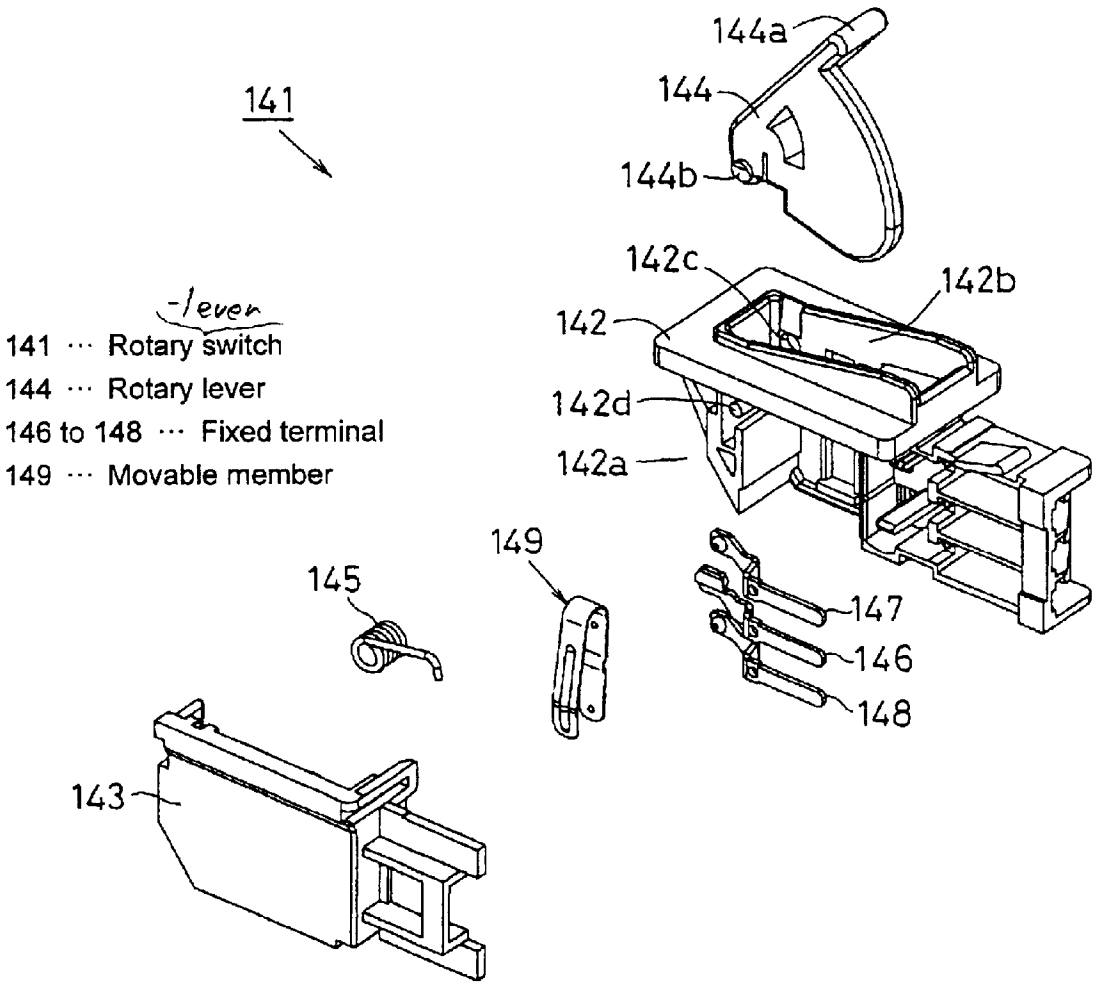
FIG. 15 is a perspective development that shows the rotary-lever switch.

In FIGS. 14 and 15, the rotary-lever switch 141 comprises a housing 142, a cover 143, a rotary lever 144, a restoring spring 145, three fixed terminals 146 to 148 and a movable member 149 that are integrally structured.

The housing 142 has a hollow section inside thereof in which the above-mentioned constituent parts are assembled, and this hollow section is sealed with a cover 143, which will be described later.

The cover 143, which is the same as the cover 13 shown in FIG. 3, is inserted through a side face opening 142*a* of the housing 142, and integrally attached thereto, in the same manner as push button switch 11.

Figure 16:
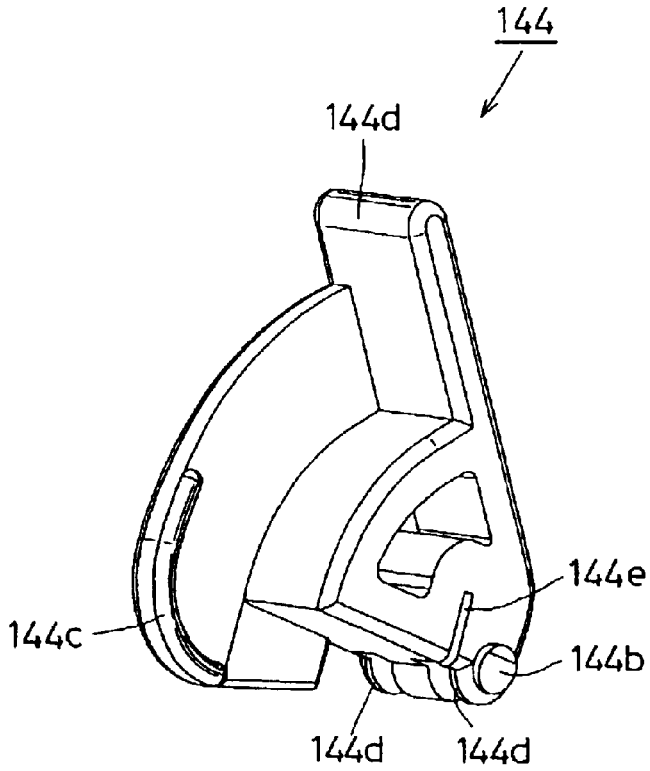
FIG. 16 is an enlarged perspective view that shows a rotary-lever lever.

FIG. 16 shows the rotary lever 144, and the rotary lever 144 has an arc shape in which a lever depressing member 144*a* is extended and placed diagonally upward along its tilted upper face, and a support shaft 144*b* is placed on both of the side faces in the center angle portion of the arc shape on the lower portion, and one portion of the support shaft 144*b* is supported by a shaft supporting portion 13*b* (see FIG. 3) formed on the inner side face of the cover 143, while the other portion of the support shaft 144*b* is supported by a shaft supporting hole 142*c* formed as an opening on the inner side face of the housing 142. Thus, the rotary lever 144 is attached to the housing 142 so as to freely rotate on these shaft supporting portions serving as the rotation base points.

The rotary lever 144 is inserted to a lever attaching opening 142*b* of the housing 142 from above, and is supported with a lever pressing member 144*a* that serves as a pressing face of the rotary lever 144 sticking out upward so as to be pressed down, while receiving a pressing force of a restoring spring 145, which will be described later, and when the lever pressing member 144*a* that is extended long diagonally upward is subjected to an external force horizontally, the rotary lever 144 is allowed to rotate on the support shaft 144*b* sticking out on both of the sides.

Moreover, a semi-circular sliding protrusion 144*c* is formed on one side face on the lower portion of the rotary lever 144 in a manner so as to stick out, and this semi-circular sliding protrusion 144*c* is allowed to contact a movable member 147 having the same structure as the movable member 19 that has been described in FIG. 5 so that a switching operation is carried out.

In this case, the entire portion of the semi-circular sliding protrusion 144*c* is formed into a long, thin semi-circular shape in a manner so as to stick out along the rotation direction with the support shaft 144*b* of the lever 144 serving as the rotation base point, and its contact portion is allowed to stick out in a crescent form in its cross section with the contact face being in point-contact therewith so as to slide thereon. Therefore, the two members become less susceptible to mutual abrasions, thereby making it possible to provide smoother movements.

Moreover, respective split grooves 144*d*, 144*e*, which enable expansion and contraction in the thickness direction so as to improve the attaching property of the support shaft 144*b*, are formed in the lower face of the lever 144.

The above-mentioned restoring spring 145 is made by a coil spring, and this restoring spring 145 is inserted through a spring support shaft 142*d* that sticks out horizontally inside the housing 142, and supported by this, and one end of the restoring spring 145 is secured to the housing 142, with the other end being engaged with and secured to the lower face of the arc shape of the rotary lever 144 so as to be attached thereto. Thus, by using the pressing force of the spring 145, the rotary lever 144 allows its lever pressing member 144*a* to stick out from the upper face of the housing 142 so that the rotary lever 144 is pressed so as to stick out upward from the upper face of the housing 142 in a manner so as to be pressed down.

When an external force is applied to the lever pressing member 144*a* placed thereon so as to carry out a switching operation, the rotary lever 144 is allowed to rotate downward so as to switch the contacts placed inside thereof.

The above-mentioned three fixed terminals 146 to 148 and one movable member 149 serving as contact constituent parts have the same structures as those fixed terminals 16 to 18 and movable member 19 that have been described in FIG. 5, and the common fixed terminal 146 has a fixed fulcrum 146*a*, the first fixed terminal 147 has a first fixed contact 147*a* and the second fixed terminal 148 has a second fixed contact 148*a*. Moreover, the movable member 149 has a tilt-movement fulcrum 149*a*, a first movable contact 149*b* and a second movable contact 149*c* that are placed on one member side 149A of a U shape.

Therefore, since it has the same contact structure as the above-mentioned push-button switch 11, a switching operation is carried out by using the same switching processes, and since it has the same parts, it can be used as the commonly-used part. Moreover, a fixed terminal shown in FIG. 13, which has the same contact switching structure with a partially improved portion, may be applied in the same manner. In this manner, since the switching structure of the contacts and its functions and effects are the same as those described in the above-mentioned embodiment, the description thereof is omitted.

Figure 17:
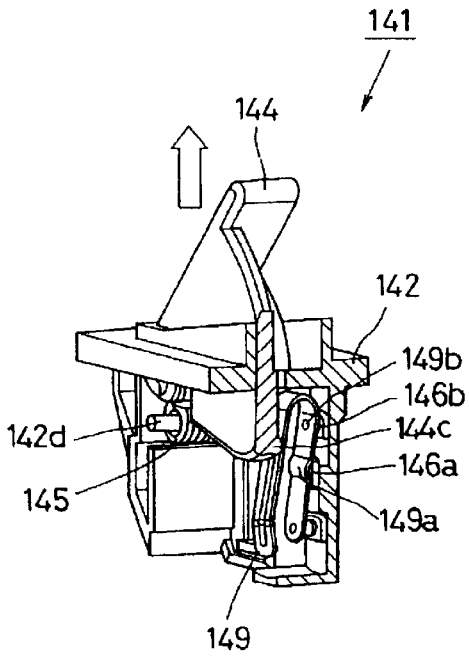
FIG. 17 is an exploded perspective view that shows an essential portion of the rotary-lever switch in a push-down stand-by state.
Figure 18:
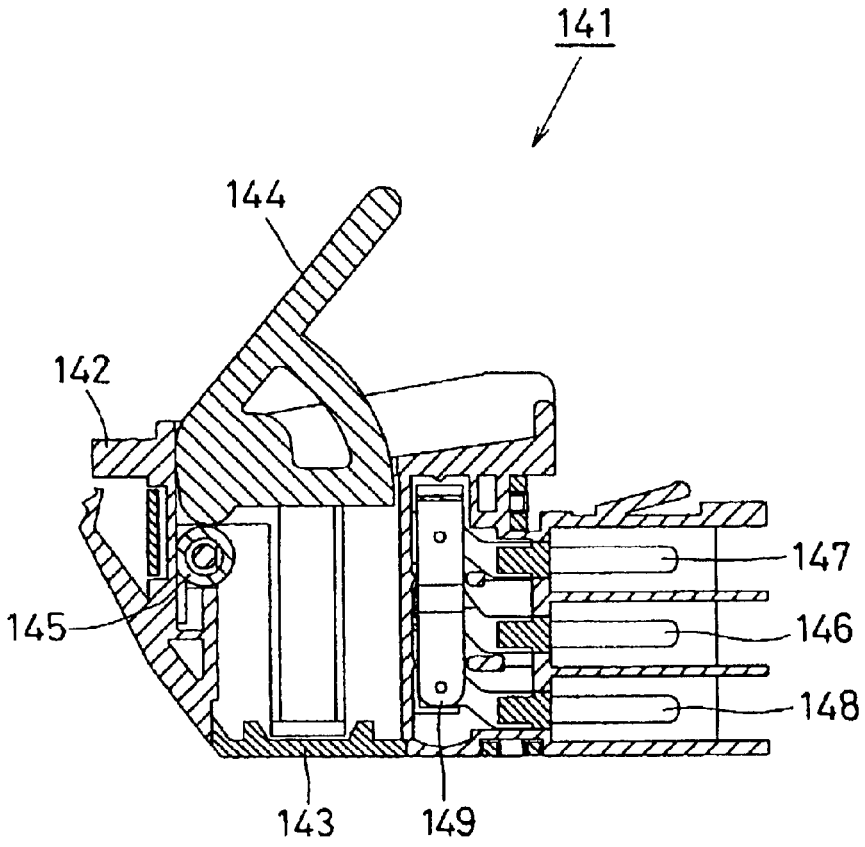
FIG. 18 is a longitudinal cross-sectional side view that shows the rotary-lever switch in a push-down stand-by state.
Figure 19:
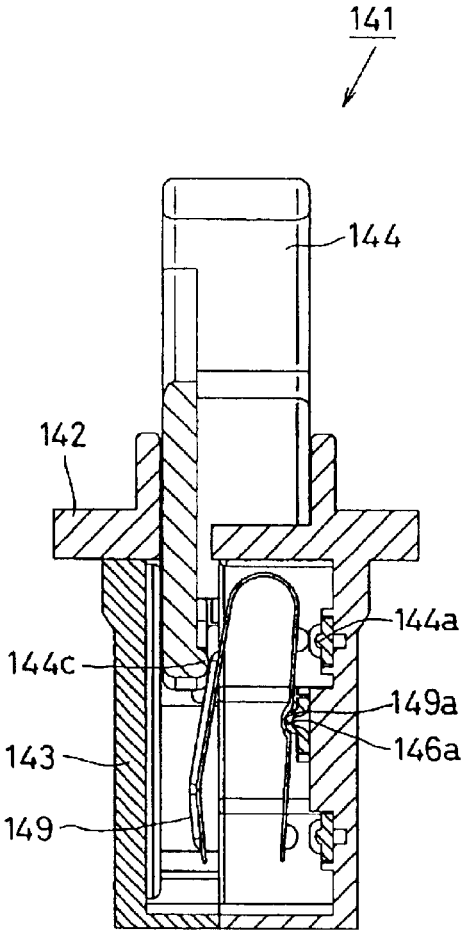
FIG. 19 is a longitudinal cross-sectional front view that shows the rotary-lever switch in a push-down stand-by state.

In the rotary-lever switch 141 having the above-mentioned arrangement, when the rotary lever 144 is not pressed, the other member side 149B of the upper portion of the movable member is pressed by the semi-circular shaped sliding protrusion 144*c* of the rotary lever so that, as shown in FIGS. 17 to 19, the tilt-movement fulcrum 149*a* of the movable member 149 is supported by the fixed fulcrum 146*a* of the common fixed terminal 146 and always maintained in a contact state, while the first movable contact 149*b* of the upper portion of the movable member is allowed to contact the first fixed contact 147*a* of the first fixed terminal 147 so that the common fixed terminal 146 and the first fixed terminal 147 are maintained in a conductive state through the movable member 149.

Figure 20:
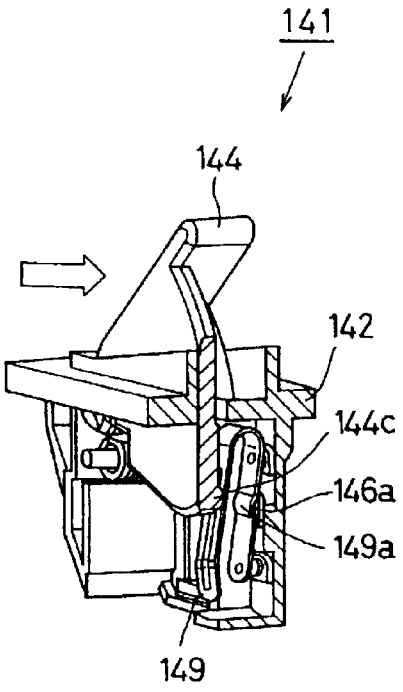
FIG. 20 is an exploded perspective view that shows an essential portion of the rotary-lever switch in a state where the push-button switch is being pressed.

Next, as shown in FIG. 20, when the rotary lever 144 is pressed by an external force applied horizontally, the rotary lever 144 is allowed to rotate downward against the pressing force of the restoring spring 145, the entire portion of the rotary lever 144 is pushed into the housing 142.

Figure 21:
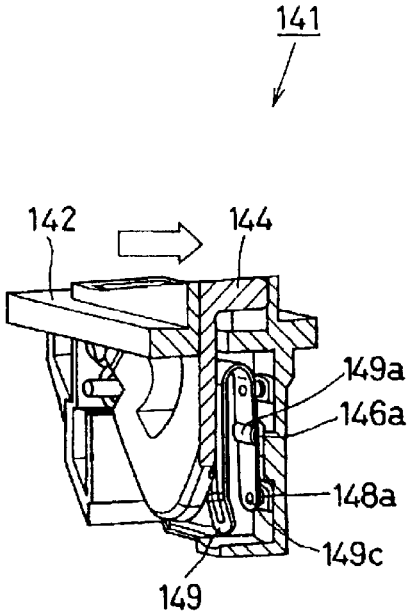
FIG. 21 is an exploded perspective view that shows an essential portion of the rotary-lever switch in a pushed-down state.
Figure 22:
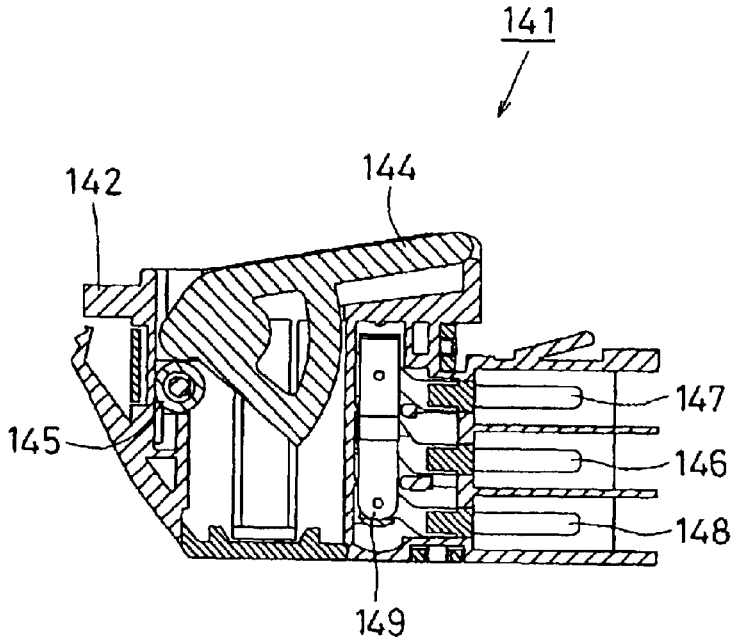
FIG. 22 is a longitudinal cross-sectional side view that shows the rotary-lever switch in a pushed-down state.
Figure 23:
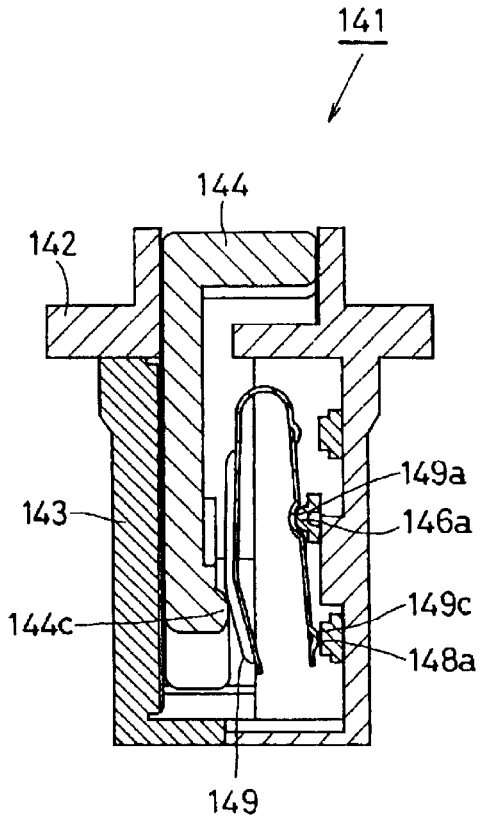
FIG. 23 is a longitudinal cross-sectional front view that shows the rotary-lever switch in a pushed-down state.

In this case, the semi-circular sliding protrusion 144*c* of the rotary lever 144 is allowed to slide and advance along the other member side 149B of the movable member 149 having a spring property, and when it passes through the position of the tilt-movement fulcrum 149*a* of the movable member 149, it is reversed in a see-saw fashion due to the elastic force holding property of the U shape on the tilt-movement fulcrum 149*a* as shown in FIGS. 21 to 23 so that the first movable contact 149*b*, which has been in the conductive state, is separated from the first fixed contact 147*a* to become nonconductive, and instead of this, the second movable contact 149*c* comes into contact with the second fixed contact 148*a* so that the common fixed terminal 146 and the second fixed terminal 148 are set to a conductive state.

When the movable member 149 is reversed, the movable member itself is energetically reversed instantaneously due to a snapping operation resulting from a repulsive force of the U-shaped plate spring member so that it is possible to eliminate the generation of an arc and also prevent the generation of an oxide film on the contact faces. Thus, it becomes possible to provide a stable contact performance with high reliability.

When the rotary lever 144 is further pushed in so that the lever pressing member 144*a* of the rotary lever 144 becomes flush with the upper face of the housing, the rotation is stopped. When the external force is released from the rotary lever 144 in this pushed-down state, the rotary lever 144 is allowed to retreat to the original push-down stand-by position by receiving a restoring force of the restoring spring 145, and the movable member 149 is also reversed to return to the original position. Thus, the contact portions carry out reverse operations in a manner opposite to the above-mentioned movements, to return to the initial state, thereby carrying out a switching operation between the contacts.

Figure 24:
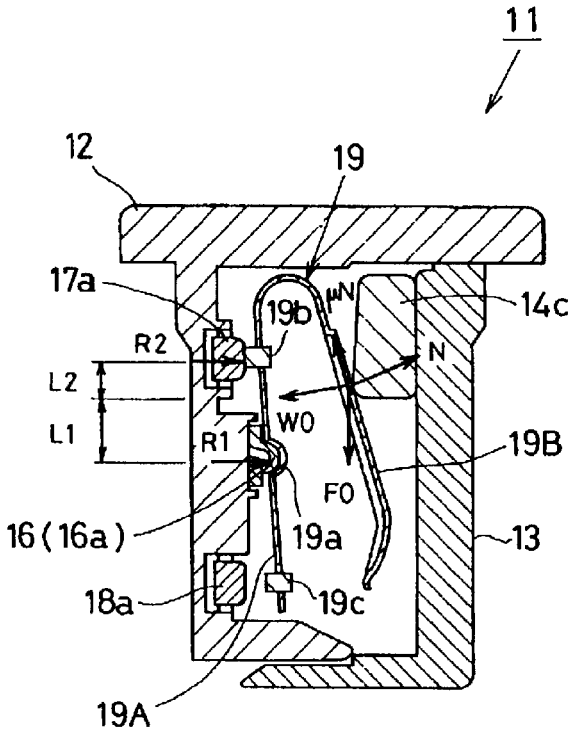
FIG. 24 is an explanatory drawing of operations that shows an initial position of a movable member.
Figure 25:
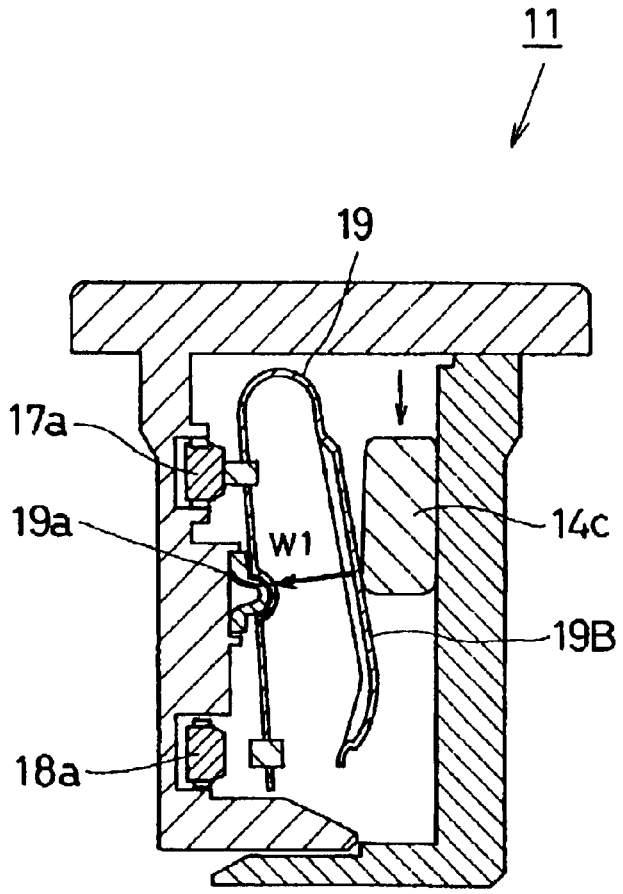
FIG. 25 is an explanatory drawing of operations that shows a position of the movable member immediately before a reversing process.
Figure 26:
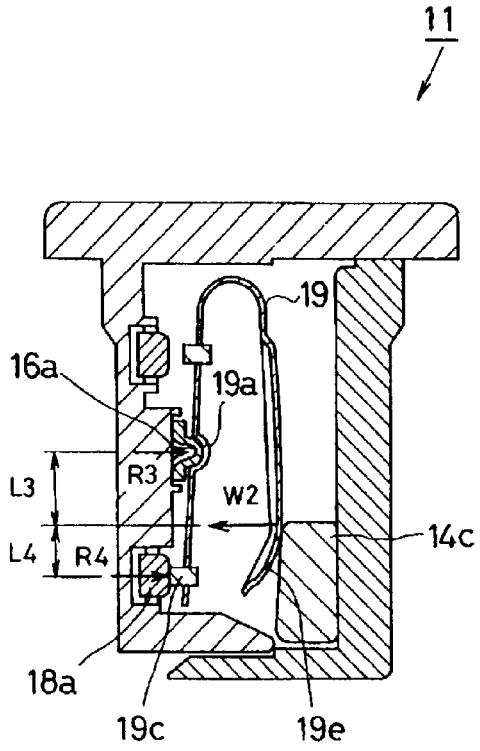
FIG. 26 is an explanatory drawing of operations that shows a shifted state of the movable member after the reversing process.

Here, referring to operation explanatory drawings of FIGS. 24 to 26, the following description will discuss the contacting principle and contacting function of the movable member 19 of the aforementioned push-button switch 11 in its movable shifting processes.

FIG. 24 shows the initial position of the movable member 19 in its push-down stand-by state, a contacting force, exerted on portions between the movable contacts 19*b*, 19*c* and fixed contacts 17*a*, 18*a* that are allowed to contact each other, and a contact force, exerted on portions between the movable member 19 and the common fixed terminal 16, are determined by the strength of a force (when the force is analyzed, a force W0 in the horizontal direction, an upward force $\mu$N, a downward force F0 and a repulsive force N are generated) that is varied in cooperation with the movement of the tilt protrusion 14*c* that is placed on the lower portion of the push button 14 and integrally moved vertically, and that is generated when the other member side 19B of the movable member 19 that is in contact with the tilt protrusion 14*c* is elastically shifted and deformed in the compressing direction (inward), and the distances from the positions at which the force in the horizontal direction is exerted on mutual contact portions of the upper and lower movable contacts 19*b*, 19*c* and the upper and lower fixed contacts 17*a*, 18*a* and the movable member 19 and the common fixed terminal 16.

In the case when the tilt protrusion 14*c* with the push button being not pressed is in the push-down stand-by initial position, with respect to the position at which the force W0 in the virtually horizontal direction is exerted, it is set at such a position that the force is exerted between the normally closed contacts 17*a*, 19*b* and the tilt-movement fulcrum 19*a* and provides a uniform contact force that is suitable for the contact between the contact points. At this time, supposing that:

- R1: contact force between contact points of the tilt-movement fulcrum 19*a* and the fixed fulcrum 16*a;*
- R2: contact force between contact points of the first movable contact 19*b* and the first fixed contact 17*a;*
- W0: force that is exerted virtually in the horizontal direction;
- L1: distance from the tilt-movement fulcrum 19*a* to the position at which the force W0 in the horizontal direction is exerted; and
- L2: distance from the first movable contact 19*b* to the position at which the force W0 in the horizontal direction is exerted, the contact forces R1 and R2 are found by the following equations:

$$R1=W0\cdot(L2/L1+L2)$$

$$R2=W0\cdot(L1/L1+L2)$$

FIG. 25 shows a state in which the tilt protrusion 14*c* is moved downward in response to the push button that has been pressed, and in the middle of the descent, the movable member 19 is shifted immediately before the reversion, and the tilt protrusion 14*c* gradually presses the other member side 19B of the movable member 19 so that the contact force between the side of the fixed contacts 17*a*, 18*a* and the movable member 19 side is increased. At this time, the position of the movable member 19 immediately before the reversion at the time when the force W1 exerted on the other member side 19B of the movable member 19 has reached the tilt-movement fulcrum 19*a* is indicated.

FIG. 26 shows an operation limit position at which the tilt protrusion 14*c* has been shifted to the lowest position, which corresponds to the completion of the pressing operation of the push button, and even in this operation limit position, the force W2, given to movable member 19, is exerted between the normally-closed contact portions 18*a*, 19*c* and the tilt fulcrum 19*a* because of the formation of the elbowed-shaped bent portion 19*e* so that it is possible to obtain a uniform contact force that is suitable for contact between the contact points. In this case, supposing that:

- R3: contact force between contact points of the tilt-movement fulcrum 19*a* and the fixed fulcrum 16*a;*
- R4: contact force between contact points of the second movable contact 19*c* and the second fixed contact 18*a;*
- W2: force that is exerted virtually in the horizontal direction;
- L3: distance from the tilt-movement fulcrum 19*a* to the position at which the force W2 in the horizontal direction is exerted; and
- L4: distance from the second movable contact 19*c* to the position at which the force W2 in the horizontal direction is exerted, the contact forces R3 and R4 are found by the following equations:

$$R3=W2\cdot(L4/L3+L4)$$

$$R4=W2\cdot(L3/L3+L4)$$

Moreover, the contact area between the tilt protrusion 14*c* and the movable member 19 is determined, and the elbowed-shaped bent portion 19*e*, formed by bending the lower end of the other member side 19B of the movable member 19 inward, is provided so as to limit the length of the contact area, thereby making it possible to ensure a uniform contact force suitable for the contact between the contact points. Consequently, even when switching operations that make the movable member 19 repeatedly reversed in a see-saw fashion are carried out, it is possible to always exert a uniform, stable contact force on the movable member 19.

Third Exemplary Embodiment

Figure 27:
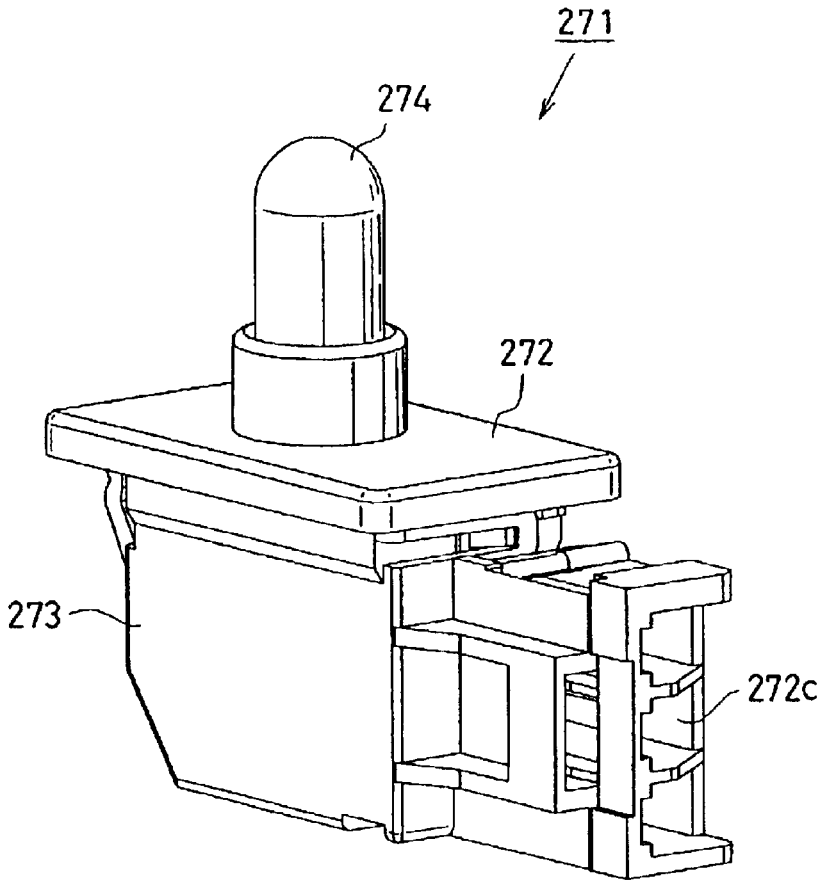
FIG. 27 is a perspective view that shows an external appearance of another push-button switch.
Figure 28:
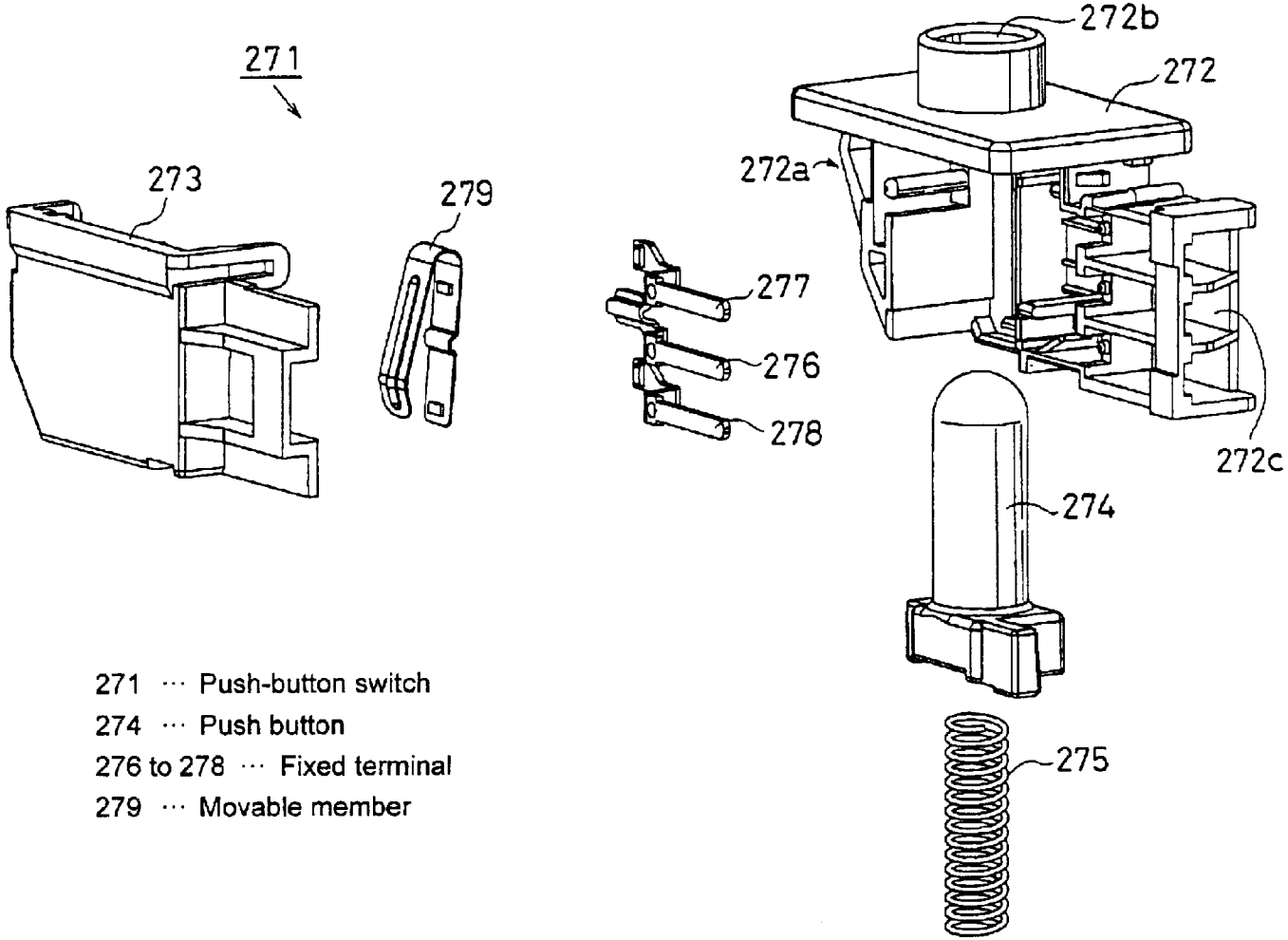
FIG. 28 is a perspective development that shows another push-button switch.

FIGS. 27 and 28 show another example of push-button switch 271 which is used as a door switch of a refrigerator. The push-button switch 271 has a housing 272 which is installed and that can be commonly applied to push-button switches of several kinds, a cover 273, a push-button switch 274, a restoring spring 275, three fixed terminals 276 to 278 and a movable member 279 that are integrally assembled into one unit.

Figure 29:
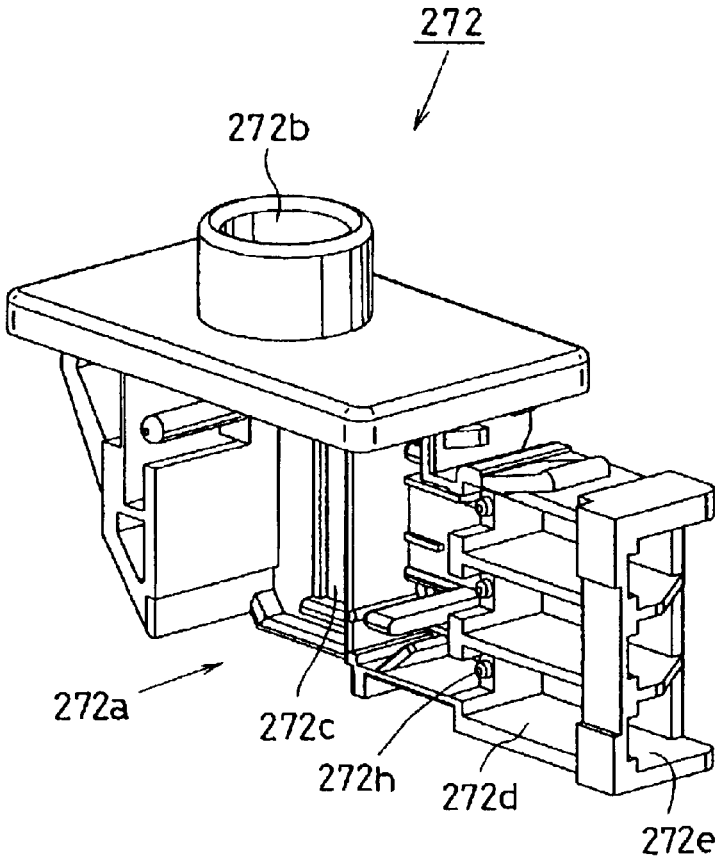
FIG. 29 is a perspective view that shows a housing of another push-button switch.

FIG. 29 shows the housing 272, and the housing 272 has a hollow section inside thereof in which the above-mentioned constituent parts are assembled, and the push-button 274, the restoring spring 275, the three fixed terminals 276 to 278 and the movable member 279 are assembled therein through one side face opening 272*a* of this hollow section, and this one side face opening 272*a* is sealed with a cover 273, which will be described later.

Moreover, a cylinder section 272*b* which penetrates vertically is formed on the upper face of the housing, and the push-button 274 is attached through this so as to freely slide vertically, with the restoring spring 275 being housed in a space between the cylinder and the push-button 274 in a compressed state. Moreover, a movable-member attaching unit 272*c* for holding the movable member 279 is placed at a position adjacent to the inner side of the push button 274, and fixed terminal attaching units 272*d* that have triple sections that are divided in vertical direction and aligned side by side and the terminal connecting opening 272*e* thereof are placed at a position adjacent to the movable member 279.

Figure 30:
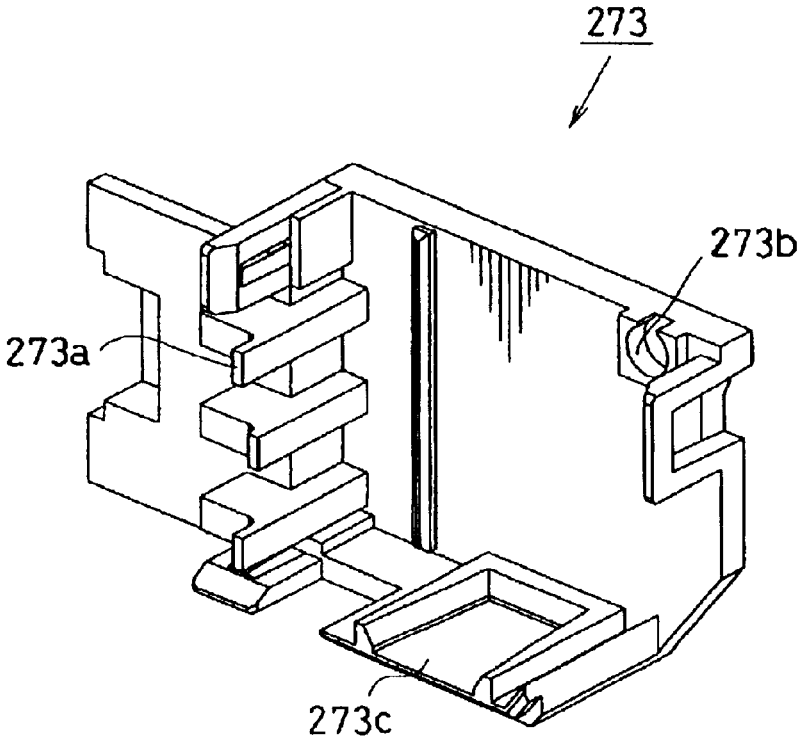
FIG. 30 is an enlarged perspective view that shows a cover of another push-button switch.

FIG. 30 shows the cover 273, and the cover 273 is inserted through one side face opening 272*a* of the housing 272, and attached thereto, and partition members 273*a*, which individually separates and supports the fixed terminals 276 to 278 and the movable member 279, which will be described later, are placed on the inner face of the cover 273.

Here, a shaft-support unit 273*b*, which has been designed so as to be commonly used with a rotary-lever switch having a different specification type, is placed on one side of the upper portion of the cover 273 so that this cover 273 of one kind can be used for both of a switch of the push-button type and a switch of the rotary lever type switch.

Figure 31:
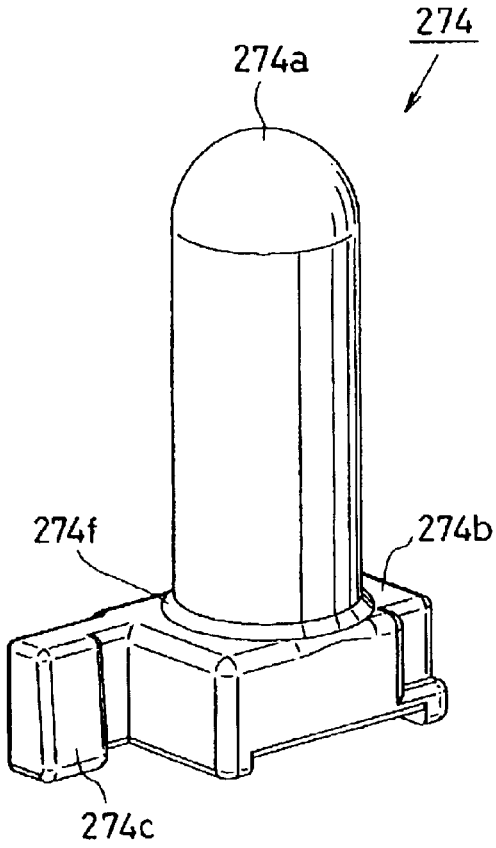
FIG. 31 is an enlarged perspective view that shows another push-button switch.
Figure 32:
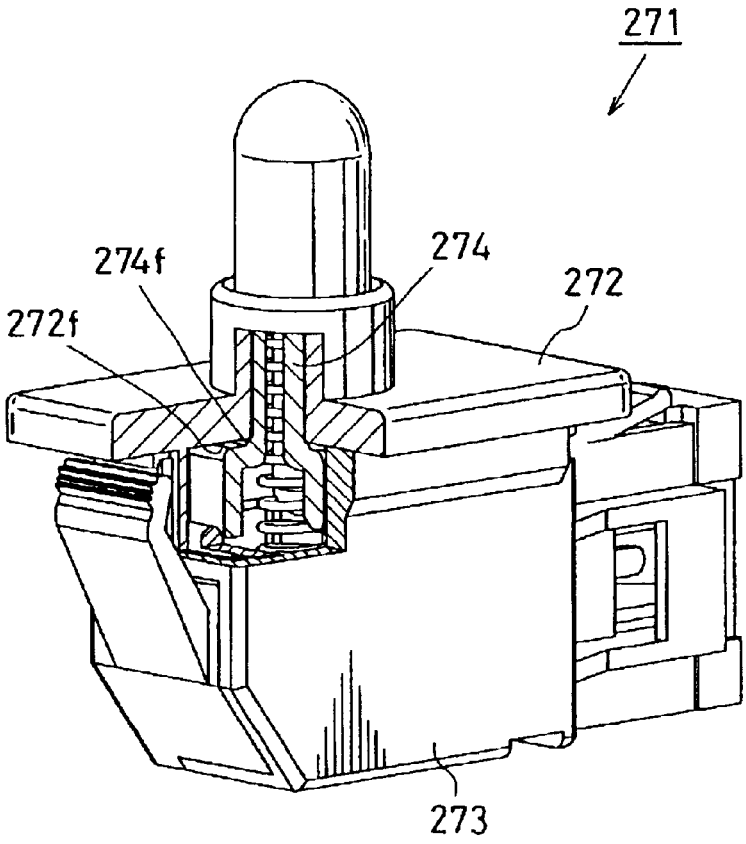
FIG. 32 is an exploded perspective view that shows an essential portion of a sealing structure of another push-button switch.
Figure 33:
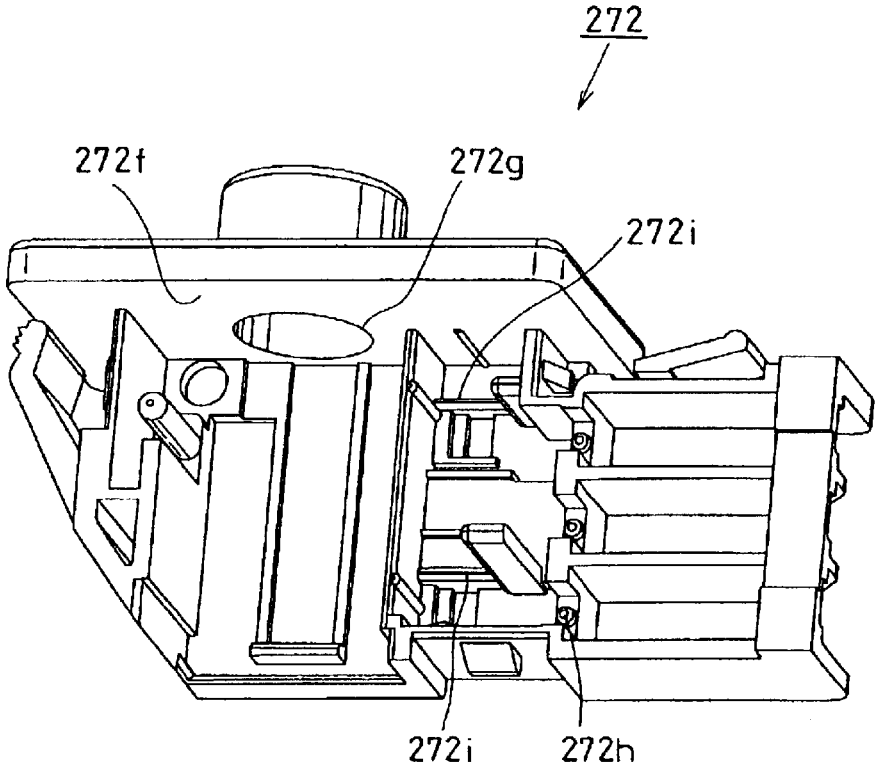
FIG. 33 is a perspective view of another housing when viewed from diagonally below.

FIG. 31 shows the push button 274, and in this push button 274, a tip portion of a cylinder body that extends long in the vertical direction is set at a pressing face 274*a*, and a stopping block 274*b* is placed on the lower portion. The push button 274 is inserted into the cylinder section 272*b* of the housing 272 from below, and attached thereto in a manner so as to freely slide vertically with the cylinder section 272*b* serving as a guide. Thus, it is supported with the pressing face 274*a* of the push-button 274 sticking upward so as to be pressed by receiving a pressing force of the restoring spring 275, which will be described later. In this case, as shown in FIGS. 32 and 33, the stopping block 274*b* of the push-button 274 is engaged by an engaging stop face 272*f* inside the housing 272 so that the push-button 274 is integrally supported by the housing 272 so as not to come off.

In this case, as shown in FIG. 31, in order to improve the water tightness between sliding faces of the push-button 274 and the housing 272, a tapered face 274*d* is formed on the peripheral face of the lower portion of the cylinder of the push-button 274. With this arrangement, when it is in a press-down stand-by state while assembled in the housing 272, the tapered face 274*d* is allowed to press and contact the peripheral edge portion 272*g* of the opening of the cylinder section 272*b* of the housing by the pressing force of the restoring spring 275 to form a temporary watertight structure.

In this manner, it is possible to form the simplified watertight structure simply by forming the tapered face 274*d*, and consequently to prevent water from invading into the housing from the push-button section. For this reason, it is possible to provide a watertight structure without the necessity of any sealing member such as rubber, and also to desirably select the attaching direction of the door switch since there is no water invasion into the housing.

Additionally, a ring-shaped protruding portion (not shown) may be formed on the face of the stopping block 274*b* of the push-button 274 so that this protruding portion is made in contact with the engaging stop face 272*f* inside the housing 272 so as to form a simplified watertight structure.

Moreover, a tilt protrusion 274*c* is formed on one side of the lower portion of the push-button 274 in a manner so as to stick out, and this tilt protrusion 274*c* is allowed to-contact the movable member 279, which will be described later, so as to carry out a switching operation.

The above-mentioned restoring spring 275 is made of a coil spring, and the upper end is inserted into the lower-face concave section 274*d* (see FIG. 35) of the push-button 274 with the lower end being allowed to elastically press a spring mount 273*c* formed on the lower face of the cover 273. Thus, it is housed and supported in a manner so as to be compressed vertically with the push-button 274 being pressed and supported in the housing 272 so as to be pressed.

Figure 34:
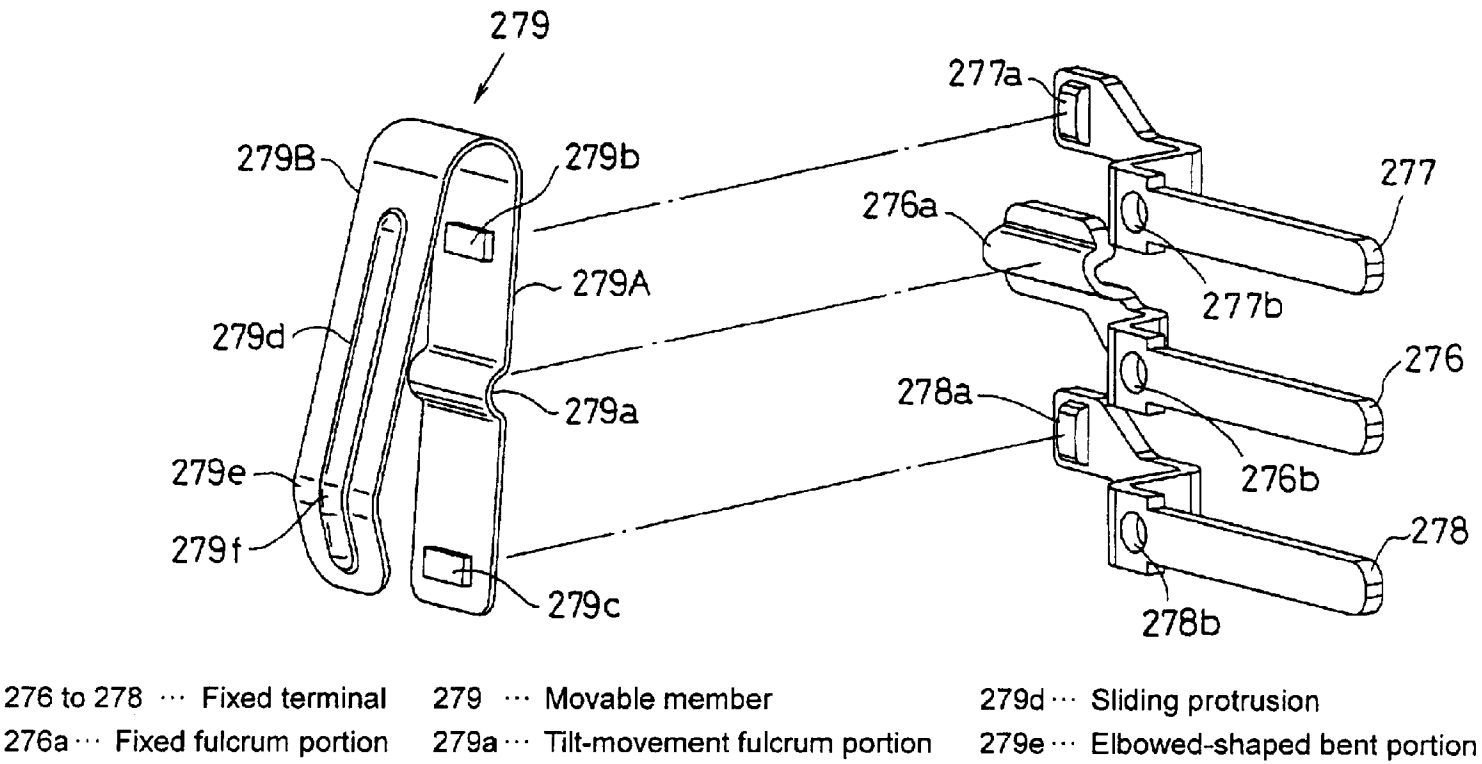
FIG. 34 is a perspective view that shows external appearances of a movable member and a fixed terminal of another push-button switch.

FIG. 34 shows three fixed terminals 276 to 278 and one movable member 279 serving as contact constituent parts, and the respective fixed terminals 276 to 278, which are formed by a conductive metal plate having a long, thin flat-plate shape, are independently placed in three rows in parallel with each other, and a first fixed terminal 277 is formed on the upper position with a second fixed terminal 278 being integrally attached to the housing 272 on the lower position in parallel therewith, in a manner so as to sandwich the common fixed terminal 276 located in the intermediate position. Thus, the common fixed terminal 276 has a fixed fulcrum 276*a* that is formed at its tip, and sticks out with a chevron.

Moreover, a small first fixed contact 277*a* having a rectangular parallelepiped shape is attached to the tip flat face of the first fixed terminal 277 that is placed on the upper position through a caulking and securing process, and in the same manner, a small second fixed contact 278*a* is attached to the tip flat face of the second fixed terminal 278 that is placed on the lower side through a caulking and securing process. In this case, since the first fixed terminal 277 and the second fixed terminal 278 have the same shape and the same functions, the same part may be commonly used as these.

Moreover, upon attaching these terminals, positioning holes 276*b* to 278*b* formed in the center portions of the respective fixed terminals 276 to 278 are fitted to positioning pins 272*h* of the housing 272 so as to be attached to predetermined positions accurately.

The movable member 279 is formed in a long bent U shape by using a metal plate having a conductive spring property, and, of the two members 279A, 279B having this bent portion as an apex, a tilt-movement fulcrum 279*a* that serves as a concave section relating to the protruding fixed fulcrum 276*a* that sticks out at the tip of the common fixed terminal 276 is formed at an intermediate position of the one member side 279A in the length direction, and a first movable contact 279*b* which sticks out toward the fixed contact side is attached to the upper side of this tilt-movement fulcrum 279*a* through a caulking and securing process, while a second movable contact 279*c* which sticks out toward the fixed contact side is attached to the lower side of the tilt-movement fulcrum 279*a* through a caulking and securing process.

Here, the tilt-movement fulcrum 279*a* of the movable member 279 and the fixed fulcrum 276*a* of the common fixed terminal 276 that opposes to this are engaged as the concave and convex portions so that the movable member 279 is supported in a manner so as to freely tilt and move. In this case, the other member side 279B of the movable member 279 is pressed by a tilt protrusion 274*c* of the push button 274 so as to press one member side 279A so that the contact portions with the fixed terminal side are in a contacted state. Thus, upon a switching operation, when these are moved vertically in cooperation with the movement of the tilt protrusion 274*c* that sticks out toward the lower portion of the push-button 274, and when the tilt protrusion 274*c* exceeds the position of the tilt-movement fulcrum 279*a*, switching is made from a pressing force applied to the upper side of the movable member to a pressing force to be applied to the lower side of the movable member, and in response to this switching, the movable member 279 is reversed in a see-saw fashion on the tilt-movement fulcrum 279*a* so that the contacts are switched.

For this reason, during the switching operation, the movable member 279 is tilted and moved so that either of the movable contacts 279*b*, 279*c* is allowed to contact and press the opposing one of the fixed contacts 277*a*, 278*a* on the fixed terminals 277, 278, thereby allowing electrical conduction. Moreover, when the pressing operation of the push button 274 is released, the movable member 279 is allowed to carry out a reverse operation in a see-saw fashion in an opposite manner on the tilt-movement fulcrum 279*a*, thereby returning to the original state of the contacts.

Moreover, with respect to the U-shaped movable member 279, a sliding protrusion 279*d*, which sticks out with an elongated semi-circular shape in the length direction in the center portion of the outer face of the other member 279B, is formed thereon, and the tilt protrusion 274*c* of the push button is allowed to always contact the sliding protrusion 279*d* along the length direction thereof.

In this case, since the sliding protrusion 279*d* is attached to the movable member 279 so that it is allowed to make not a face contact, but a point contact with the tilt protrusion 274*c* of the push button at the time of a switching operation so that the mutual members are less susceptible to abrasions, thereby making it possible to provide a longer service life as well as smooth movements.

Moreover, the lower end of the other member 279B is bent inward into an elbowed shape so as to form an elbowed-shaped bent portion 279*e*. This elbowed-shaped bent portion 279*e* is designed so that, even when a push-in force of the push button 274 is exerted, the apex 279*f* of the sliding protrusion 279*d* on the elbowed-shaped bent portion 279*e* always serves as a contact point. Therefore, it is possible to provide a stable contacting force in addition to the elastic function of the movable contact member having a U shape.

Figure 35:
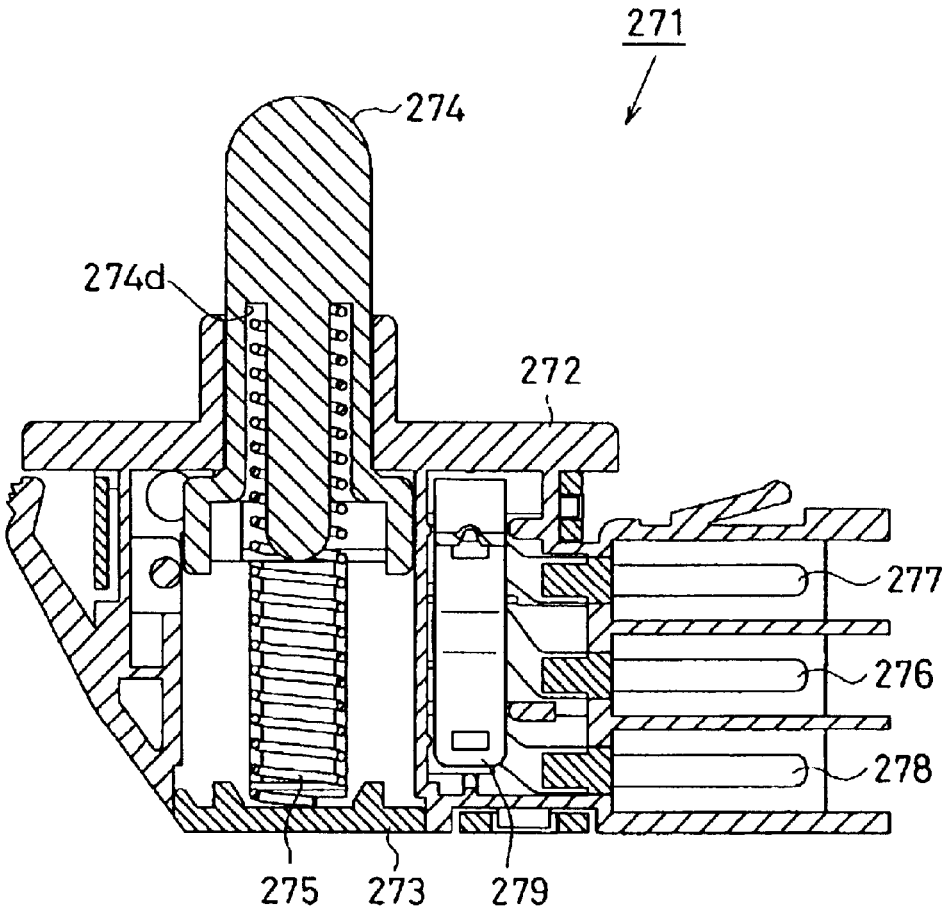
FIG. 35 is a longitudinal cross-sectional side view that shows another push-button in a push-down stand-by state.
Figure 36:
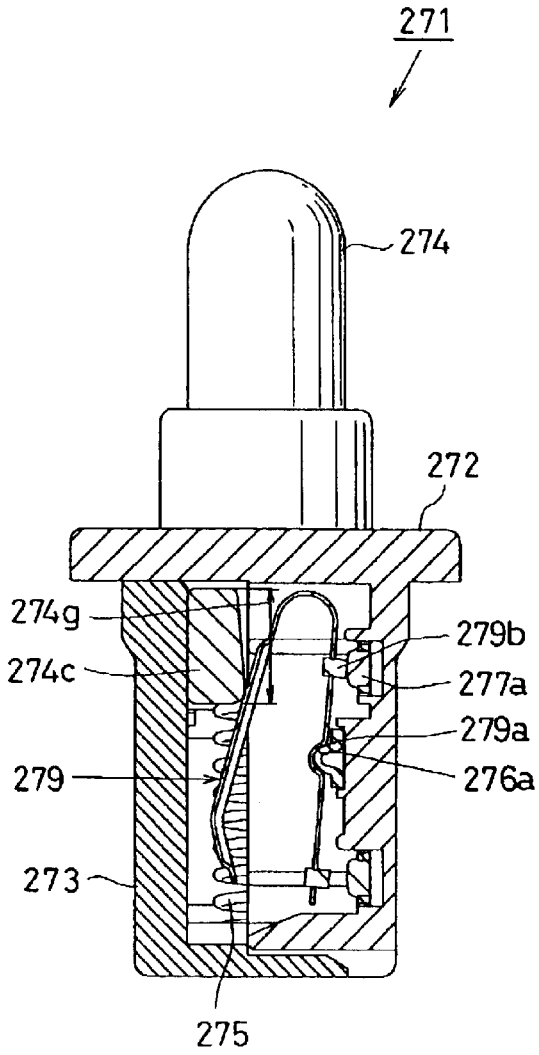
FIG. 36 is a longitudinal cross-sectional front view that shows another push-button in a push-down stand-by state.

In the push-button switch 271 having the above-mentioned arrangement, in a state in which the push button 274 is not pressed while the door is open, as shown in FIGS. 35 and 36, the other member 279B of the upper portion of the movable member is pressed by the tilt protrusion 274*c* of the push button so that the tilt-movement fulcrum 279*a* of the-movable member 279 is supported by the fixed fulcrum 276*a* of the common fixed terminal 276, and is always maintained in a contact state, while the first movable contact portion 279*b* on the upper portion of the movable member is allowed to contact the first fixed contact portion 277*a* of the first fixed terminal 277 so that the common fixed terminal 276 and the first fixed terminal 277 are maintained in a conductive state through the movable member 279.

Next, when the push button 274 is operated and pressed, the push button 274 is shifted downward straightly against a pressing force of the restoring spring 275 so that the upper portion of the push button 274 is pushed into the housing 272.

At this time, the tilt protrusion 274*c* of the-push button 274 and the movable member 279 are moved in the same manner as described in FIGS. 9 to 12 in the first embodiment, the figures thereof are omitted.

The tilt protrusion 274*c*, which is shifted downward upon pressing the push-button, is allowed to advance while sliding along the other member 279B of the movable member 279 having a spring property, and when this passes through the position of the tilt-movement fulcrum 279*a* of the movable member 279, the movable member 279 is reversed in a see-saw fashion on the tilt-movement fulcrum 279*a* because of an elastic force holding property of the U shape, with the result that the first movable contact portion 279*b*, which has been in a conductive state, is separated from the first fixed contact portion 277*a* to become nonconductive, while, instead of this, the second movable contact portion 279*c* is allowed to contact the second fixed contact portion 278*a* so that the common fixed terminal 276 and the second fixed terminal 278 are set in a conductive state.

When the movable member 279 is reversed, the movable member itself is energetically reversed instantaneously due to a snapping operation resulting from a repulsive force of the U-shaped plate spring member so that it is possible to eliminate the generation of an arc and also prevent the generation of an oxide film. Thus, it becomes possible to provide a stable contact performance with high reliability.

When the push button 274 is further pushed down, the lower end of the push button 274 comes into contact with the bottom face of the cover 273, and stopped. When the external force of the push button 274 is released from this pushed-down state, the push button 274 is allowed to retreat to the original pushed-down stand-by position by receiving a restoring force of the restoring spring 275, and the movable member 279 is also reversed to return to the original position. Thus, the contact portions carry out reverse operations in a manner opposite to the above-mentioned movements, to return to the initial state, thereby carrying out a switching operation between the contacts.

Moreover, when the tilt length 274*g* (see FIG. 36) of the tilt protrusion 274*c* of the push button 274 that is allowed to contact the sliding protrusion 279*d* of the movable member 279 is made longer, it is possible to obtain a longer push-down stroke with respect to the movable member 279, and consequently to improve the contact stability to the movable member 279.

Here, the supporting structure which allows the movable member 279 to be reversed in a see-saw fashion is preferably designed so that one of the tilt-movement fulcrum 279*a* on the movable member 279 side and the fixed fulcrum 276*a* on the common fixed terminal 276 side for receiving this is formed as a concave section with the other portion being formed as a convex portion. Thus, it is possible to provide a stable tilt-moving function by using a simple structure.

Moreover, excessive tilt-movement regulating protrusions 272*i* (see FIG. 33), which regulate the movable member 279 from tilting and moving excessively, are respectively formed on the inner wall face of the housing opposing to the upper and lower fixed contacts 277*a*, 278*a*.

In the case when the first movable contact 279*b* and the first fixed contact 277*a* on the upper side, or the second movable contact 279*c* and the second fixed contact 278*a* on the lower side, are removed to form a switch having a single-pole single-throw type contact structure, the contact parts on the unused side are preliminarily omitted. Therefore, these excessive tilt-movement regulating protrusions 272*i* are formed so that, even when spaces are formed in the corresponding portions, the excessive tilt-movement regulating protrusions 272*i* regulate excessive tilt-movements of the movable member 279 at the space positions so as to maintain an appropriate tilt-movement state.

Thus, the formation of these excessive tilt-movement regulating protrusions 272*i* makes it possible to regulate the movable member 279 that tilts and moves in a see-saw fashion from making excessive tilt-movements by the excessive tilt-movement regulating function of the protrusions 272*i*. Consequently, it becomes possible to provide a common housing 272 that can be commonly used for both of the switch of the single-pole single-throw type and the switch of the single-pole double-throw type, that is, two kinds of switches having different contact structures.

For example, as shown in FIG. 37, in the case when the housing 272 is applied to a push-button switch 271A of the single-pole single-throw type as the normally-closed contact structure, the first movable contact 279*b* and the first fixed contact 277*a*, placed on the upper side, are left with the second movable contact and the second fixed contact being preliminarily omitted in the manufacturing process. Thus, the necessary constituent parts are used and assembled.

Figure 37B:
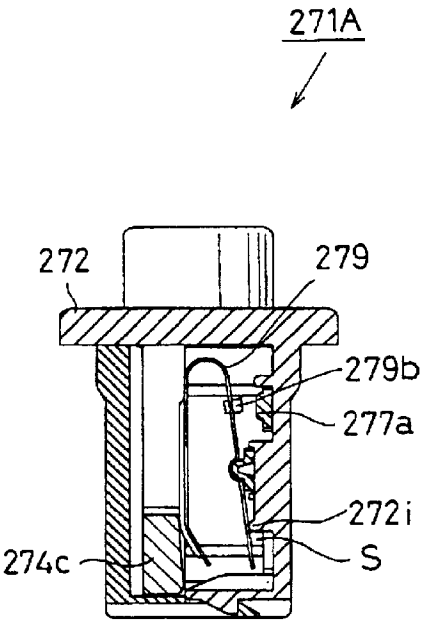
FIG. 37 is a longitudinal cross-sectional front view that shows a switching operation state of a normally-closed contact structure.
Figure 37A:
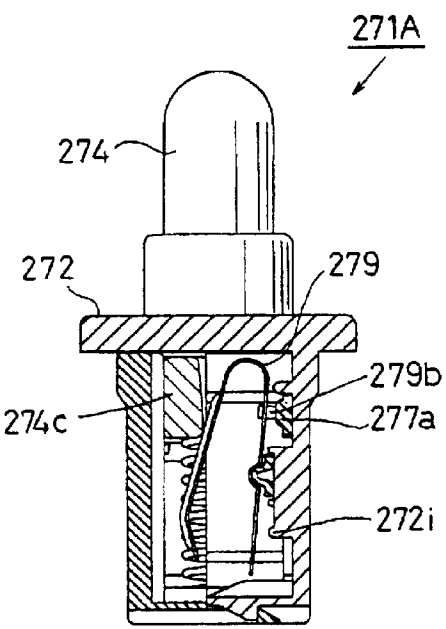

In a push-down stand-by state with the push button 274 of the push-button switch 271A being not pressed, as shown in FIG. 37A, the first movable contact 279*b* and the first fixed contact 277*a* are in a normally-closed contact state in which these are normally made in contact with each other.

As shown in FIG. 37B, when the push button 274 is pressed in this normally-closed contact state, the movable member 279 is pressed by the push-button tilt protrusion 274*c* to be reversed in a see-saw fashion, the normally-closed contact on the upper side is switched from the closed state to the open state.

In this case, the lower portion of the movable member 279 is prevented from excessively tilting and moving at the position of the space corresponding to the removed contact portion by the excessive tilt-movement regulating protrusions 272*i* that tilt and move so as to receive and regulate the movable member 279. Thus, it is possible to regulate the position with an appropriate tilt-movement angle.

Consequently, since the movable member 279 is regulated from excessive tilt-movements so that the movable member 279 is prevented from unstable movements such as positional deviations, it is possible to accurately maintain the balance of the contact structure, and consequently to ensure stable switching operations.

Figure 38B:
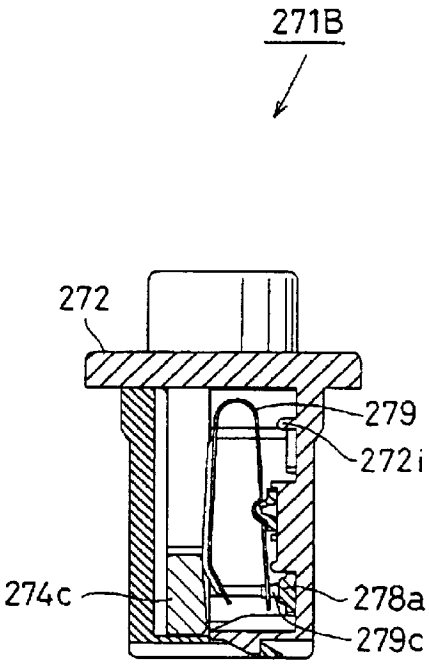
FIG. 38 is a longitudinal cross-sectional front view that shows a switching operation state of a normally-opened contact structure.
Figure 38A:
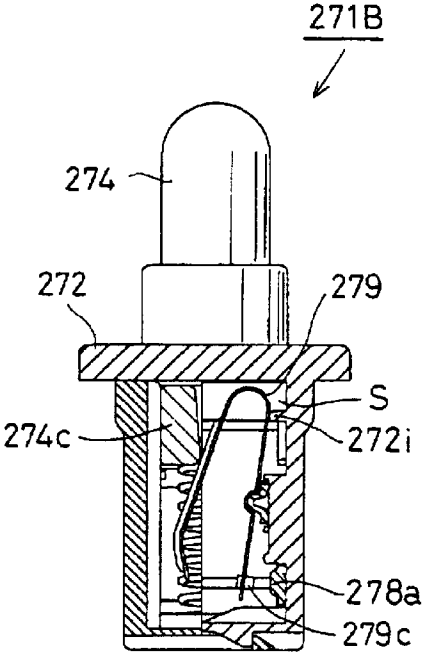

FIG. 38 shows a push-button switch 271B of the single-pole double-throw type in which the housing 272 is applied to the normally-open contact structure, and in this case, the second movable contact 279*c* and the second fixed contact 278*a*, placed on the lower side, are left with the first movable contact and the first fixed contact being preliminarily omitted in the manufacturing process. Thus, the necessary constituent parts are used and assembled.

In a push-down stand-by state with the push button 274 of the push-button switch 271B being not pressed, the second movable contact 279*c* and the second fixed contact 278*a* are in a normally-opened contact state in which these are normally separated from each other.

In this case, the upper portion of the movable member 279 is prevented from excessively tilting and moving at the position of the space corresponding to the removed contact portion by the excessive tilt-movement regulating protrusions 272*i* that tilt and move so as to receive and regulate the movable member 279. Thus, it is possible to regulate the position of the movable member 279 with an appropriate tilt-movement angle.

When the push button 274 is pressed in this normally-opened contact state, the movable member 279 is pressed by the push-button tilt protrusion 274*c* to be reversed in a see-saw fashion as shown in FIG. 38B, and the normally-closed contact on the lower side is switched from the open state to the closed state.

Figure 39B:
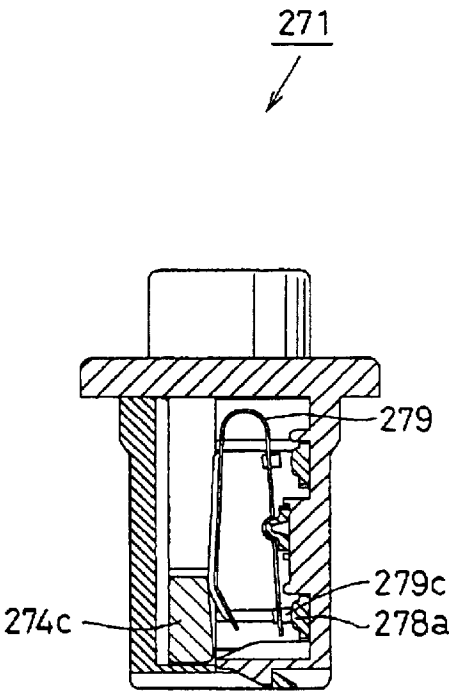
FIG. 39 is a longitudinal cross-sectional front view that shows a switching operation state of a normally-closed and normally-opened contact structure.
Figure 39A:
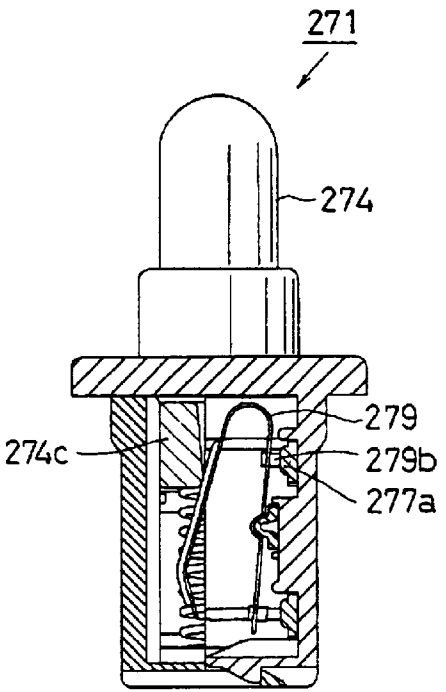

FIG. 39 shows a push-button switch 271 of the single-pole double-throw type in which the housing 272 is applied to the normally-closed and normally-open contact structure, as also shown in FIG. 36. In this case, in a push-down stand-by state with the push button being not pressed, the first movable contact 279*b* and the first fixed contact 277*a* are in a normally-closed contact state in which these are always made in contact with each other, as shown in FIG. 39A. For example, when the upper side comes to have the closed contact state in association with the opening door of the refrigerator, the lamp for illuminating the inside thereof is turned on in accordance with the close signal on the upper side, and the output of the cooling motor is simultaneously stopped.

When the push button 274 is pressed in this normally-closed contact state, the movable member 279 is pressed by the push-button tilt protrusion 274*c* to be reversed in a see-saw fashion as shown in FIG. 39B, and the normally-closed contact on the upper side is switched from the closed state to the open state. Simultaneously with this switching operation, the second movable contact 279*c* and the second fixed contact 278*a* on the lower side are allowed to contact each other so that switching is made from the open state to the closed state.

In response to the closed signal on the lower side, for example, the cooling motor of the refrigerator is activated so that the lamp for illuminating the inside thereof is turned off. In this case, since the contacts are respectively located on the upper and lower sides, no space that causes excessive tilt-movements is formed in the contact portions.

Figure 40:
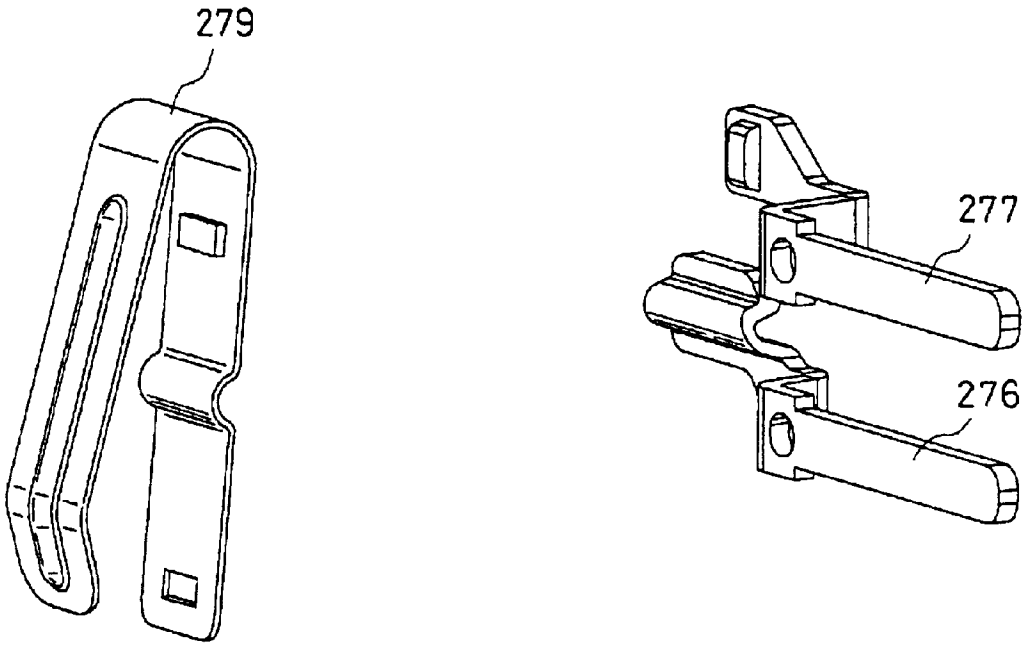
FIG. 40 is a perspective view that shows external appearances of a movable member and a fixed terminal that are used in the normally-closed contact structure.

FIG. 40 shows a structure that is constituted by three parts, that is, the movable member 279, the first fixed terminal 277 and the common fixed terminal 276 of the push-button switch 271A of the single-pole single-throw type that is applied to the normally-closed contact structure shown in FIG. 37. In this case, on the movable member 279 side, it is possible to provide a structure from which the second movable contact has been omitted, and on the fixed terminal side, it is possible to omit the second fixed terminal itself.

Figure 41:
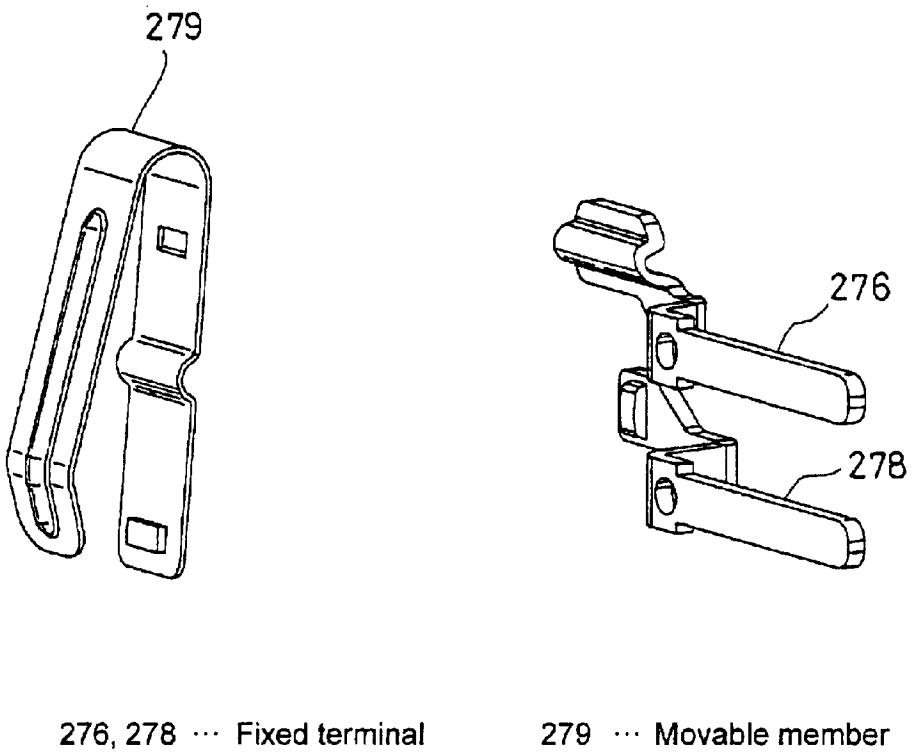
FIG. 41 is a perspective view that shows external appearances of a movable member and a fixed terminal that are used in the normally-opened contact structure.

FIG. 41 shows a structure that is constituted by three parts, that is, the movable member 279, the common fixed terminal 276 and the second fixed terminal 278 of the push-button switch 271B of the single-pole single-throw type that is applied to the normally-opened contact structure shown in FIG. 38. In this case, on the movable member 279 side, it is possible to provide a structure from which the first movable contact has been omitted, and on the fixed terminal side, it is possible to omit the first fixed terminal itself.

Fourth Embodiment

Figure 42:
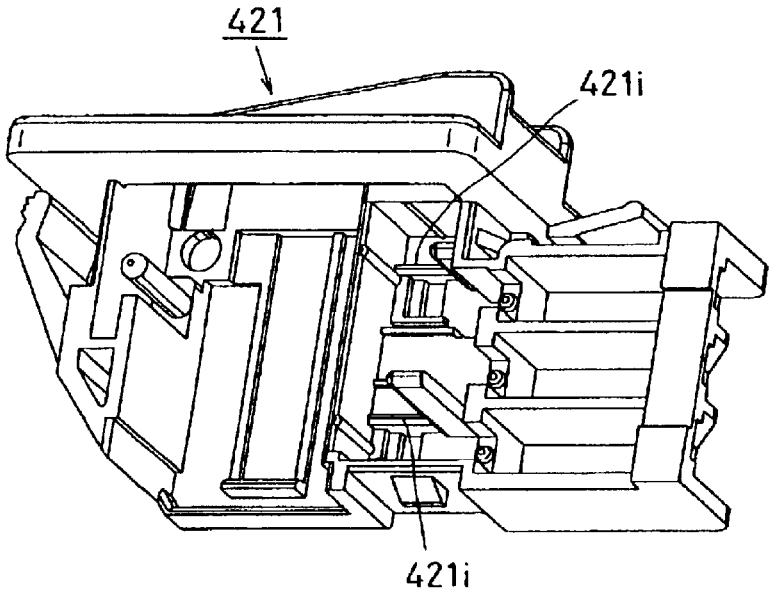
FIG. 42 is a perspective view that shows an external appearance of a housing that is used in another rotary-lever switch.

FIG. 42 shows a housing 421 that is used for a rotary-lever switch to be applied to a door switch of a refrigerator, and this rotary-lever switch is different from the rotary-lever switch of the aforementioned second embodiment only in the housing 421 with the other structures being the same.

Therefore, the following description will discuss only the different points.

This housing 421 is designed so that excessive tilt-movement regulating protrusions 421*i* are placed on positions corresponding to the upper and lower contacts, and the housing provided with these excessive tilt-movement regulating protrusions 421*i*, which regulate excessive tilt-movements of the movable member, is applied to switches of a plurality of kinds having different contact structures, in the same manner as the third embodiment.

As described above, since the contact switching mechanism having a see-saw structure for reversing the movable member in response to a switching operation is placed, this movable member itself is allowed to serve as a common part that has both contact functions and restoring spring functions. Thus, it is possible to cut costs by reducing the number of parts and the number of assembling processes, and also to achieve a miniaturized device by eliminating wasteful spaces inside thereof. Moreover, upon switching the contacts, since the movable contact member itself is formed by a plate spring member that is bent in a U shape, and the U-shaped plate spring member is reversed energetically in a see-saw fashion in such a manner that the snapping action makes it possible to switch the contacts. Thus, it becomes possible to provide a quick switching operation, and consequently to prevent the generation of an arc between the contacts. Moreover, since this contact-switching mechanism for a switch is also applied to both a switch of a push-button type and a switch of a rotary lever type. Therefore, it is possible to provide enhanced common use.

Moreover, in the case when an excessive tilt-movement regulating protrusion is placed in the housing, since unstable movements of the movable member, such as positional deviations, etc., can be prevented, it is possible to maintain an appropriate orientation and consequently to ensure a stable switching operation.

With respect to correspondences between the structure of the present invention and the structure of the above-mentioned preferred embodiments, the common fixed contact member of the present invention corresponds to fixed terminals 16, 146 in the respective embodiments, and in the same manner;

first fixed contact member corresponds to the first fixed terminals 17, 147 and 277;

second fixed contact member corresponds to the second fixed terminals 18, 148, 278;

movable contact member corresponds to the movable members 19, 149 and 279; and arc-shaped protrusion corresponds to semi-circular sliding protrusion 144*c*; however, the present invention is not intended to be limited by only the constructions of the above-mentioned embodiments, and may be modified as understood by one skilled in the art.

In accordance with the present invention, a see-saw-shaped contact-switching mechanism is installed so that it is possible to reduce the number of parts and the number of assembling processes, and also to reduce costs by simplifying the inner structure. Moreover, since the mechanism quickly switches the contacts by carrying out a reversing process energetically, it becomes possible to prevent the generation of an arc between the contacts, and consequently to provide superior contact performances.

Moreover, when an excessive tilt-movement regulating protrusion is placed in the housing, it is possible to stabilize the movement of the movable member even when the number of parts is reduced, and consequently to obtain contact performances with high contact reliability, and it is also possible to reduce manufacturing costs of various kinds of switches by allowing the housing to be commonly used in switches of various types.

What is claim is:

1. A switch, which has a concave-shaped housing with one side opened, a cover to seal the opened face and a fixed conductive contact member and a movable contact member placed face to face with each other in the housing such that an operative force of operation members that are held in the housing and operated is transmitted to the movable contact member so that the movable contact member is moved and shifted to connect and separate the contacts to perform a switching operation, comprising:

a common fixed contact member and a fixed contact member, different from the common fixed contact member, placed in parallel with each other in the housing, and said movable contact member having a tilt-movement fulcrum portion placed orthogonal to the parallel arranging direction of respective fixed contact members, freely tiltable in the orthogonal direction, while being pressed toward a common fixed contact member side, at an intermediate position on one side member of a conductive plate spring member formed into a U shape, and a contact portion formed at one end of the one side member in a length direction with the tilt-movement fulcrum portion in a movable shifting direction of the one side member serving as a base point, wherein a contact switching mechanism, which performs a switching operation by reversing the movable contact member in a seesaw manner, based upon the operative force of the operation members that are in contact with the movable contact member along an outer face length direction on the other side member thereof, with respect to contacting and separating processes between the contact portion of the fixed contact member and the contact portion of the movable contact member that are placed face to face with each other, with the tilt-movement fulcrum portion of the movable contact member being in contact with the contact portion of the common fixed contact member, is installed.

2. The switch according to claim 1, wherein the contact switching mechanism comprises a concave section or a convex portion of the tilt-movement fulcrum portion formed on the plate plane of the movable contact member and is engaged with the corresponding convex portion or concave section of the common fixed contact member.

3. The switch according to claim 1, wherein the contact switching mechanism comprises a concave section of the tilt-movement fulcrum portion formed on the plate plane of the movable contact member and is engaged with a protruding portion that is formed on an opposing plate plane of the common fixed contact member to protrude with a bent shape.

4. A switch, which has a concave-shaped housing with one side opened, a cover to seal the opened face and a fixed conductive contact member and a movable contact member placed face to face with each other in the housing such that an operative force of operation members that are held in the housing and operated is transmitted to the movable contact member so that the movable contact member is moved and shifted to connect and separate the contacts to perform a switching operation, comprising:

a common fixed contact member, a first fixed contact member and a second fixed contact member placed on both side positions sandwiching the common fixed contact member in parallel with each other in the housing;

the movable contact member having a tilt-movement fulcrum portion placed orthogonal to the parallel arranging direction of respective fixed contact members, freely tiltable in the orthogonal direction, while being pressed toward a common fixed contact member side, at an intermediate position on one side member of a conductive plate spring member formed into a U shape, the movable contact member having a first movable contact portion and a second movable contact portion formed on both of the side positions in a length direction on one side member that sandwich the tilt-movement fulcrum portion in a movable shifting direction of the one side member, wherein a contact switching mechanism, which performs a switching operation by reversing the movable contact member in a seesaw manner, based upon the operative force of the operation members that are in contact with the movable contact member along an outer face length direction on the other side member thereof, with respect to contacting and separating processes between the first fixed contact member and the first movable contact portion corresponding to one side as well as contacting and separating processes between the second fixed contact member and the second movable contact portion corresponding to the other side, with the tilt-movement fulcrum portion of the movable contact member being in contact with the contact portion of the common fixed contact member, is installed.

5. A switch, which has a concave-shaped housing with one side opened, a cover to seal the opened face and a fixed conductive contact member and a movable contact member placed face to face with each other in the housing such that an operative force of operation members that are held in the housing and operated is transmitted to the movable contact member so that the movable contact member is moved and shifted in a see-saw fashion to connect and separate contacts of the two opposing contact members to perform a switching operation, comprising:

a common fixed contact member having a fulcrum portion supporting the movable contact member in a see-saw fashion, which is secured to the housing, a fixed contact member that is secured to the housing in parallel with one or both of two side positions centered on the common fixed contact member; and a movable contact member placed orthogonal to the parallel aligning direction of the fixed contact members, and having a tilt-movement fulcrum portion placed orthogonal to a parallel arranging direction of respective fixed contact members, and freely tiltable in a see-saw fashion in an orthogonal direction, while being pressed toward the fulcrum portion of the common fixed contact member side, at an intermediate position on one side member of a conductive plate spring member formed into a U shape, and a contact portion formed at least one end of the one side member in a length direction with the tilt-movement fulcrum portion serving as a base point, wherein a contact switching mechanism, which performs a switching operation by reversing the movable contact member in a seesaw manner, based upon the operative force of the operation members that are in contact with the movable contact member along an outer face length direction on the other side member thereof, with respect to contacting and separating processes between the contact portion of the fixed contact member and a contact portion of the movable contact member placed face to face with each other, with the tilt-movement fulcrum portion of the movable contact member being in contact with the contact portion of the common fixed contact member, is installed, and an excessive tilt-movement regulating protrusion which protrudes toward the movable contact member side to prevent the movable contact member from making excessive tilt-movements is attached to an inner wall face of the housing on the fixed contact member side at which two ends of the movable contact member face each other.

6. The switch according to claim 5, wherein the excessive tilt-movement regulating protrusion has a protruding structure which is integrally formed on an inner wall face of the housing on the fixed contact member side in a manner protruding toward the movable contact member side, and receives and accepts the end of the movable contact member at a position that recedes from the contact face position of the contact portion of the fixed contact member.

7. A switch, which has a concave-shaped housing with one side opened, a cover to seal the opened face and a fixed conductive contact member and a movable contact member placed face to face with each other in the housing such that an operative force of operation members that are held in the housing and operated is transmitted to the movable contact member so that the movable contact member is moved and shifted in a see-saw fashion to connect and separate the contacts of the two opposing contact members to perform a switching operation, comprising:

a common fixed contact member having a fulcrum portion supporting the movable contact member in a see-saw fashion, which is secured to the housing, a first fixed contact member and a second fixed contact member secured to the housing in parallel with at least one side of the positions centered on the common fixed contact member, and a movable contact member placed orthogonal to the parallel aligning direction of the fixed contact members, and having a tilt-movement fulcrum portion placed orthogonal to the parallel arranging direction of respective fixed contact members, freely tiltable in a see-saw fashion in the orthogonal direction, while being pressed toward the fulcrum portion of the common fixed contact member side, at an intermediate position on one side member of a conductive plate spring member formed into a U shape, and a first movable contact portion and a second movable contact portion formed on at least one end of two side positions in a length direction of the one side member centered on the tilt-movement fulcrum portion in the movable shifting direction of the one side member, wherein a contact switching mechanism, which performs a switching operation by reversing the movable contact member in a seesaw manner, based upon the operative force of the operation members that are in contact with the movable contact member along an outer face length direction on the other side of the member thereof, with respect to contacting and separating processes between the first fixed contact member and the first movable contact portion corresponding to one side and contacting and separating processes between the second fixed contact member and the second movable contact portion corresponding to the other side, with the tilt-movement fulcrum portion of the movable contact member being in contact with the contact portion of the common fixed contact member, is installed and an excessive tilt-movement regulating protrusion which protrudes toward the movable contact member side to prevent said movable contact member from making excessive tilt-movements is attached to each of inner wall faces of the housing on the fixed contact member side at which two ends of the movable contact member face each other.

8. A push-button switch, which has a concave-shaped housing with one side opened, a cover to seal the opened face and a fixed conductive contact member and a movable contact member placed face to face with each other in the housing such that an operative force of a push button held in the housing and operated is transmitted to the movable contact member so that the movable contact member is moved and shifted to connect and separate the contacts to perform a switching operation, comprising:

a common fixed contact member and a fixed contact member, different from the common fixed contact member, placed in parallel with each other in the housing; and the movable contact member having a tilt-movement fulcrum portion placed orthogonal to the parallel arranging direction of respective fixed contact members, freely tiltable in the orthogonal direction, while being pressed toward the common fixed contact member side, at an intermediate position on one side member of a conductive plate spring member formed into a U shape, and a contact portion formed at one end of the one side member in a length direction with the tilt-movement fulcrum portion in the movable shifting direction of the one side member serving as a base point, wherein a contact switching mechanism, which performs a switching operation by reversing the movable contact member in a seesaw manner, based upon the operative force of the push button that is in contact with the movable contact member along an outer face length direction on the other side member thereof, with respect to contacting and separating processes between a contact portion of the fixed contact member and a contact portion of the movable contact member placed face to face with each other, with the tilt-movement fulcrum portion of the movable contact member being in contact with the contact portion of the common fixed contact member, is installed;

the push button, which is attached to the housing having the contact switching mechanism installed therein so as to slide therein, with one free end being pressed to protrude outward by a restoring spring, is installed; and, upon pressing the push button or releasing the pressing of the push button, the base end of the push button allows the other member side of the movable contact member to press and contact, or to press and separate the other member side of the movable contact member, so that the movable contact member is elastically shifted to reverse the contact portion formed on one member side of the movable contact member so as to be switched to the fixed contact member side.

9. A push-button switch, which has a concave-shaped housing with one side opened, a cover to seal the opened face and a fixed conductive contact member and a movable contact member placed face to face with each other in the housing such that an operative force of a push button held in the housing and operated is transmitted to the movable contact member so that the movable contact member is moved and shifted to connect and separate the contacts to perform a switching operation, comprising:

a common fixed contact member, a first fixed contact member and a second fixed contact member placed on side positions sandwiching the common fixed contact member in parallel with each other in the housing; and the movable contact member having a tilt-movement fulcrum portion placed orthogonal to a parallel arranging direction of respective fixed contact members, freely tiltable in the orthogonal direction, while being pressed toward the common fixed contact member side, at an intermediate position on one side member of a conductive plate spring member formed into a U shape, the movable contact member having a first movable contact portion and a second movable contact portion formed on both sides of the positions in a length direction on one side member that sandwich the tilt-movement fulcrum portion in the movable shifting direction of the one side member, wherein a contact switching mechanism, which performs a switching operation by reversing the movable contact member in a seesaw manner, based upon the operative force of the push button made in contact with the movable contact member along an outer face length direction on the other side member thereof, with respect to contacting and separating processes between the first fixed contact member and the first movable contact portion corresponding to one side and contacting and separating processes between the second fixed contact member and the second movable contact portion corresponding to the other side, with the tilt-movement fulcrum portion of the movable contact member being in contact with the contact portion of the common fixed contact member, is installed;

the push button, which is attached to the housing having the contact switching mechanism installed therein so as to slide therein, with one free end being pressed to protrude outward by a restoring spring, is installed; and, upon pressing the push button or releasing the pressing of the push button, the base end of the push button allows the other member side of the movable contact member to press and contact, or to press and separate the other member side of the movable contact member, so that the movable contact member is elastically shifted to reverse either of the first movable contact portion and the second movable contact portion formed on one member side of the movable contact member so as to be switched to the fixed contact member side.

10. A push-button switch, which has a concave-shaped housing with one side opened, a cover to seal the opened face and a fixed conductive contact member and a movable contact member placed face to face with each other in the housing such that an operative force of a switch button held in the housing and operated is transmitted to the movable contact member so that the movable contact member is moved and shifted in a see-saw fashion to connect and separate the contacts of the two opposing contact members to perform a switching operation, comprising:

a common fixed contact member which has a fulcrum portion supporting the movable contact member in a see-saw fashion and is fixed in the housing, and a fixed contact member that is fixed to the housing in parallel with the common fixed contact member in a separated manner;

the movable contact member having a tilt-movement fulcrum portion placed orthogonal to a parallel arranging direction of respective fixed contact members, freely tiltable in the orthogonal direction, while being pressed toward the fulcrum portion of the common fixed contact member side, at an intermediate position on one side member of a conductive plate spring member formed into a U shape, and a contact portion formed on an end of the one member side in a length direction with the tilt-movement fulcrum portion on the one member side in the movable shifting direction serving as a base point; and a push button, which is attached to the housing so as to slide therein, with one free end being pressed to protrude outward by a restoring spring, wherein, a contact-switching mechanism, which upon pressing the push button or upon releasing the pressing of the push button, allows the base end portion of the push button to press the other member side of the movable contact member to contact or separate, with the tilt-movement fulcrum portion of the movable contact member being allowed to contact the fulcrum portion of the common fixed contact member, so that the movable contact member is elastically shifted to allow the contact portion formed on one member side of the movable contact member to reverse on the fixed contact member side to perform contact and separation between the opposing the contact portion of the fixed contact member and the contact portion of the movable contact member based upon the pressing force of the push button that contacts the other member side of the movable contact member along an outer face length direction, and reverses the movable contact member in a see-saw fashion to perform a switching operation, is installed; and an excessive tilt-movement regulating protrusion which protrudes toward the movable contact member side to prevent the movable contact member from making excessive tilt-movements and is attached to an inner wall face of the housing on the fixed contact member side at which the two ends of the movable contact member face each other.

11. A push-button switch, which has a concave-shaped housing with one side opened, a cover to seal the opened face and a fixed conductive contact member and a movable contact member placed face to face with each other in the housing such that an operative force of a switch button held in the housing and operated is transmitted to the movable contact member so that the movable contact member is moved and shifted in a see-saw fashion to connect and separate the contacts of the two opposing contact members to perform a switching operation, comprising:

a common fixed contact member which has a fulcrum portion supporting the movable contact member in a see-saw fashion and is secured in the housing, and a first fixed contact member and a second fixed contact member placed on side positions sandwiching the common fixed contact member in parallel with each other;

the movable contact member having a tilt-movement fulcrum portion placed orthogonal to a parallel arranging direction of respective fixed contact members, and freely tiltable in a see-saw fashion in the orthogonal direction, while being pressed toward the fulcrum portion of the common fixed contact member side, at an intermediate position on one side member of a conductive plate spring member formed into a U shape, and a first movable contact portion and a second movable contact portion formed on both sides of positions in a length direction on one side member that sandwich the tilt-movement fulcrum portion in the movable shifting direction of the one side member; and a push button, which is attached to the housing so as to slide therein, with one free end being pressed to protrude outward by a restoring spring, wherein, a contact-switching mechanism, which upon pressing the push button or upon releasing the pressing the push button, allows the base end portion of the push button to press the other member side of the movable contact member to contact or separate, with the tilt-movement fulcrum portion of the movable contact member being allowed to contact the fulcrum portion of the common fixed contact member, so that the movable contact member is elastically shifted to allow either of the contact portions of the first movable contact portion and the second movable contact portion formed on one member side of the movable contact member to reverse on the fixed contact member side to perform contacting and separating processes between the opposing first fixed contact member and first movable contact portion and between the other opposing second fixed contact member and second movable contact portion, based upon the pressing force of the push button that contacts the other member side of the movable contact member along an outer face length direction, and reverses the movable contact member in a see-saw fashion to perform a switching operation, is installed; and an excessive tilt-movement regulating protrusion which protrudes toward the movable contact member side to prevent the movable contact member from making excessive tilt-movements is attached to an inner wall face of the housing on the fixed contact member side at which two ends of the movable contact member face each other.

12. A rotary-lever switch, which has a concave-shaped housing with one side opened, a cover to seal the opened face and a fixed conductive contact member and a movable contact member placed face to face with each other in the housing such that an operative force of a lever held in the housing and operated is transmitted to the movable contact member so that the movable contact member is moved and shifted to connect and separate the contacts to perform a switching operation, comprising:

a common fixed contact member and a fixed contact member, different from the common fixed contact member, placed in parallel with each other in the housing;

the movable contact member having a tilt-movement fulcrum portion placed orthogonal to a parallel arranging direction of respective fixed contact members, and freely tiltable in the orthogonal direction, while being pressed toward the common fixed contact member side, at an intermediate position on one side member of a conductive plate spring member formed into a U shape, and a contact portion formed at one end of the one side member in a length direction with the tilt-movement fulcrum portion in the movable shifting direction of the one side member serving as a base point, wherein a contact switching mechanism, which performs a switching operation by reversing the movable contact member in a seesaw manner, based upon the pressing force of the lever that is in contact with the movable contact member along an outer face length direction on the other side member thereof, with respect to contacting and separating processes between the contact portion of the fixed contact member and the contact portion of the movable contact member placed face to face with each other, with the tilt-movement fulcrum portion of the movable contact member being in contact with the contact portion of the common fixed contact member, is installed;

the lever, which is attached to the housing having the contact switching mechanism installed therein, so as to freely rotate, while being pressed to protrude outward by a restoring spring, is installed; and, upon rotating the lever or returning the lever from the rotation, an arc shaped protrusion, formed on the base end of the lever along the rotation direction, presses and contacts, or presses and separates from the other member side of the movable contact member, so that the movable contact member is elastically shifted to reverse the contact portion formed on one member side of the movable contact member toward the fixed contact member side so as to be switched.

13. A rotary-lever switch, which has a concave-shaped housing with one side being opened, a cover to seal the opened face and a fixed conductive contact member and a movable contact member placed face to face with each other in the housing such that a pressing force of a lever held in the housing and operated is transmitted to the movable contact member so that the movable contact member is moved and shifted to connect and separate the contacts to perform a switching operation, comprising:

a common fixed contact member and a first fixed contact member and a second fixed contact member placed on both sides of the positions sandwiching the common fixed contact member in parallel with each other in the housing, the movable contact member having a tilt-movement fulcrum portion placed orthogonal to a parallel arranging direction of the respective fixed contact members, and freely tiltable in an orthogonal direction, while being pressed toward the common fixed contact member side, at an intermediate position on one side member of a conductive plate spring member formed into a U shape, the movable contact member having a first movable contact portion and a second movable contact portion formed the side positions in a length direction on one side member that sandwich the tilt-movement fulcrum portion in the movable shifting direction of the one side member;

wherein a contact switching mechanism, which performs a switching operation by reversing the movable contact member in a see-saw manner, based upon the pressing force of the lever that is in contact with the movable contact member along an outer face length direction on the other side member thereof, with respect to contacting and separating processes between the first fixed contact member and the first movable contact portion corresponding to one side and contacting and separating processes between the second fixed contact member and the second movable contact portion corresponding to the other side, with the tilt-movement fulcrum portion of the movable contact member being in contact with the contact portion of the common fixed contact member, is installed; a lever, which is attached to the housing having said contact switching mechanism installed therein, so as to freely rotate, while being pressed to stick outward by a restoring spring, is installed;

and, upon rotating the lever or returning the lever from the rotation, an arc shaped protrusion, formed on the base end of the lever along the rotation direction, presses and contacts, or presses and separates from the other member side of the movable contact member, so that the movable contact member is elastically shifted to reverse either of the first movable contact portion and the second movable contact portion formed on one member side of the movable contact member toward the fixed contact member side so as to be switched.

14. A rotary-lever switch, which has a concave-shaped housing with one side being opened, a cover to seal the opened face and a fixed conductive contact member and a movable contact member placed face to face with each other in the housing such that a pressing force of a lever held in the housing and operated is transmitted to the movable contact member so that the movable contact member is moved and shifted in a see-saw fashion to connect and separate the contacts of the two opposing contact members so as to perform a switching operation, comprising:

a common fixed contact member which has a fulcrum portion supporting the movable contact member in a see-saw fashion and is fixed in the housing, and a fixed contact member fixed to the housing in parallel with the common fixed contact member in a separated manner, the movable contact member having a tilt-movement fulcrum portion placed orthogonal to a parallel arranging direction of respective fixed contact members, and freely tiltable in a orthogonal direction, while being pressed toward the fulcrum portion of the common fixed contact member side, at an intermediate position on one side member of a conductive plate spring member formed into a U shape, and a contact portion formed on an end of the one member side in the length direction with the tilt-movement fulcrum portion on the one member side in the movable shifting direction serving as a base point, and a lever which is attached to the housing having the contact switching mechanism installed therein, so as to freely rotate, while being pressed to protrude outward by a restoring spring, wherein, a contact-switching mechanism, which, upon rotating the lever or returning the lever from the rotation, allows an arc shaped protrusion that is formed to protrude out along the base end portion of the lever along a rotation direction to press and contact or to press and separate from the other member side of the movable contact member, with the tilt-movement fulcrum portion of the movable contact member contacting the fulcrum portion of the common fixed contact member, so that the movable contact member is elastically shifted to allow the contact portion formed on one member side of the movable contact member to reverse on the fixed contact member side to perform contact and separation between the opposing the contact portion of the fixed contact member and the contact portion of the movable contact member based upon the pressing force of the lever that contacts the other member side of the movable contact member along an outer face length direction, and reverses the movable contact member in a see-saw fashion to perform a switching operation, is installed; and an excessive tilt-movement regulating protrusion which protrudes toward the movable contact member side to prevent the movable contact member from making excessive tilt-movements is attached to an inner wall face of the housing on the fixed contact member side at which the two ends of the movable contact member face each other.

15. A rotary-lever switch, which has a concave-shaped housing with one side being opened, a cover to seal the opened face and a fixed conductive contact member and a movable contact member placed face to face with each other in the housing such that a pressing force of a lever held in the housing and operated is transmitted to the movable contact member so that the movable contact member is moved and shifted in a see-saw fashion to connect and separate the contacts of the two opposing contact members so as to perform a switching operation, comprising:

a common fixed contact member which has a fulcrum portion supporting the movable contact member in a see-saw fashion and is fixed in the housing, and a first fixed contact member and a second fixed contact member placed on both sides of the positions sandwiching the common fixed contact member in parallel with each other;

the movable contact member having a tilt-movement fulcrum portion placed orthogonal to a parallel arranging direction of respective fixed contact members, and freely tiltable in a see-saw fashion in an orthogonal direction, while being pressed toward the fulcrum portion of the common fixed contact member side, at an intermediate position on one side member of a conductive plate spring member formed into a U shape, and a first movable contact portion and a second movable contact portion formed on both sides of the positions in a length direction on one side member that sandwich the tilt-movement fulcrum portion in the movable shifting direction of the one side member; and a lever which is attached to the housing having the contact switching mechanism installed therein, so as to freely rotate, while being pressed to protrude outward by a restoring spring, wherein, a contact-switching mechanism, which, upon rotating the lever or returning the lever from the rotation, allows an arc shaped protrusion that is formed so as to protrude out along the base end portion of the lever along the rotation direction to press and contact or to press and separate from the other member side of the movable contact member, with the tilt-movement fulcrum portion of the movable contact member contacting the fulcrum portion of the common fixed contact member, so that the movable contact member is elastically shifted to allow either of the contact portions of the first movable contact portion and the second movable contact portion formed on one member side of the movable contact member to reverse on the fixed contact member side to perform contacting and separating processes between the opposing first fixed contact member and first movable contact portion as well as between the other opposing second fixed contact member and second movable contact portion, based upon the pressing force of the lever that contacts the other member side of the movable contact member along an outer face length direction, and reverses said movable contact member in a see-saw fashion to perform a switching operation, is installed; and an excessive tilt-movement regulating protrusion which protrudes toward the movable contact member side to prevent the movable contact member from making excessive tilt-movements is attached to an inner wall face of the housing on the fixed contact member side at which the two ends of the movable contact member face each other.

16. The switch according to claim 1, wherein the movable contact member sets one member side of the U-shaped plate spring member as direct contacting use with the other member side being set as external force receiving use, so that a tilt-movement fulcrum portion placed on the one member side is pressed to contact the fulcrum portion of the common fixed contact member and freely tilts and moves in a see-saw fashion, with the open end of the other member side formed inward to an elbowed shape forming an elbowed shape bent portion.

17. The switch according to claim 1, wherein the movable contact member sets one member side of the U-shaped plate spring member as contacting use with the other member side being set as external force receiving use, so that a tilt-movement fulcrum portion placed on the one member side is pressed to contact the fulcrum portion of the common fixed contact member and freely tilts and moves in a see-saw fashion, with a sliding protrusion that protrudes long along the center portion of the outer face in a length direction on the other member side being formed.

* * * * *